US009211726B2

(12) United States Patent
Katsuragi

(10) Patent No.: US 9,211,726 B2
(45) Date of Patent: Dec. 15, 2015

(54) IMAGE FORMING METHOD AND IMAGE FORMING APPARATUS

(71) Applicant: Koji Katsuragi, Kanagawa (JP)

(72) Inventor: Koji Katsuragi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 138 days.

(21) Appl. No.: 14/060,690

(22) Filed: Oct. 23, 2013

(65) Prior Publication Data

US 2014/0125731 A1 May 8, 2014

(30) Foreign Application Priority Data

Nov. 2, 2012 (JP) ..... 2012-242599
Sep. 26, 2013 (JP) ..... 2013-199296

(51) Int. Cl.

| | |
|---|---|
| ***B41J 2/01*** | (2006.01) |
| ***B41J 11/00*** | (2006.01) |
| ***B41J 2/21*** | (2006.01) |
| ***B41M 5/00*** | (2006.01) |

(52) U.S. Cl.

CPC ..... *B41J 11/0015* (2013.01); *B41J 2/2107* (2013.01); *B41J 2/2114* (2013.01); *B41M 5/0017* (2013.01); *B41J 2/01* (2013.01)

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 11/002; B41J 2/2056; B41J 2/21; B41J 2/0057; B41J 3/60; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00; B41M 7/0072; B41M 5/52; B41M 5/5218

USPC ..... 347/100, 95, 96, 101, 102, 88, 99, 103, 347/20, 21; 106/31.6, 31.27, 31.13; 523/160, 161

See application file for complete search history.

(56) References Cited

U.S. PATENT DOCUMENTS

| | | | | |
|---|---|---|---|---|
| 8,382,271 | B2 | 2/2013 | Goto et al. | |
| 2003/0116055 | A1 | 6/2003 | Kubota et al. | |
| 2004/0252169 | A1 | 12/2004 | Chen et al. | |
| 2005/0168552 | A1* | 8/2005 | Arita et al. | 347/100 |
| 2010/0295891 | A1* | 11/2010 | Goto et al. | 347/21 |
| 2011/0234679 | A1* | 9/2011 | Saito | 347/20 |
| 2011/0279517 | A1* | 11/2011 | Katsuragi | 347/21 |
| 2012/0113195 | A1 | 5/2012 | Katsuragi | |

(Continued)

FOREIGN PATENT DOCUMENTS

| | | |
|---|---|---|
| JP | 3689444 | 6/2005 |
| JP | 4194531 | 10/2008 |

(Continued)

*Primary Examiner* — Manish S Shah
(74) *Attorney, Agent, or Firm* — Oblon, McClelland, Maier & Neustadt, L.L.P.

(57) ABSTRACT

To provide an image forming method, which contains: applying a treatment liquid onto a recording medium; and applying a recording ink onto the recording medium, wherein the treatment liquid contains a cationic resin having a cationic degree of 5 or higher, nonionic polyacryl amide, an alkali salt of a C12-C18 olefin-maleic acid copolymer, an organic solvent, a surfactant, and water, and wherein the recording ink contains a colorant, an organic solvent, a surfactant, and water.

10 Claims, 7 Drawing Sheets

(56) References Cited

U.S. PATENT DOCUMENTS

| | | | |
|---|---|---|---|
| 2012/0169815 | A1 | 7/2012 | Katsuragi |
| 2013/0063524 | A1 | 3/2013 | Katoh et al. |

FOREIGN PATENT DOCUMENTS

| | | |
|---|---|---|
| JP | 4448649 | 1/2010 |
| JP | 4570118 | 8/2010 |

* cited by examiner

IMAGE FORMING METHOD AND IMAGE FORMING APPARATUS

BACKGROUND OF THE INVENTION

1. Field of the Invention

The present invention relates to an image forming method and image forming apparatus, which use a treatment liquid and a recording ink.

2. Description of the Related Art

Inkjet recording has widely used because of its advantages, such as low noise, and low running cost. Conventionally, dyes that have high solubility have been used for an ink of an inkjet printer to avoid clogging of the ink. In order to produce an image required to have water resistance and light fastness, such as a poster, however, an ink containing a pigment as a colorant has become more common.

When a color image is printed by an inkjet printer, moreover, in order to prevent blurring at an interface of different colors, such as an area where two colors are overlapped, penetration of an ink has been enhanced by adding a surfactant to the ink.

In accordance with the method for enhancing the penetration of the ink, bleeding can be prevented in a certain degree. However, the colorant penetrates deep into a recording medium together with the ink as a result of the enhanced penetration of the ink with respect to the recording medium, and therefore problems occur, such as low image density, and low color saturation.

Regarding the improvements of the inkjet recording method as mentioned above, known is an inkjet recording method using a treatment liquid having a function of aggregating the colorant contained in the ink.

For example, disclosed is a method for forming an image on a porous recording medium having excellent ink absorbency using an ink containing a self-dispersible pigment and a polyurethane binder, an ionic polymer precipitant or acidic precipitant (see Japanese Patent (JP-B) No. 4194531).

Moreover, disclosed is an image forming method, in which an inkjet ink containing an anionic dye or anionic compound and a pigment is aggregated using a liquid composition containing a cationic material and a nonionic high molecular material in combination to thereby prevent bleeding (see JP-B No. 3689444).

Moreover, disclosed is an image forming method, in which an ejected amount of an ink is reduced by using an ink for forming a secondary color in addition to inks of three colors, Y, M, and C in an ink set containing the inks and a reaction liquid that reacts with the inks, to thereby prevent creases of a recording medium (see JP-B No. 4448649).

Furthermore, disclosed is an image forming method, in which a high density image is formed without causing curling or cockling by using a treatment liquid containing a high concentration of a cationic high molecular material that reduces dispersibility of a recording ink containing an anionic colorant (see JP-B No. 4570118).

However, these image forming methods are used on an inkjet sheet or plain paper, which has excellent ink absorbency. If these methods are used on a recording medium of low absorbency, such as coated paper used for commercial printing, adjacent dots are joined together to cause beading, and transfer contamination, for example, to a conveying roller, is significantly caused as the recording medium is conveyed at high speed, such as in a line engine system.

SUMMARY OF THE INVENTION

The present invention aims to provide an image forming method, which has high adaptability to a recording medium, and form a high quality image having excellent abrasion resistance without causing beading even when a recording medium of low absorbency is used, such as coated paper used in commercial printing.

As the means for solving the aforementioned problems, the image forming method of the present invention contains:

applying a treatment liquid onto a recording medium; and applying a recording ink onto the recording medium, wherein the treatment liquid contains a cationic resin having a cationic degree of 5 or higher, nonionic polyacryl amide, an alkali salt of a C12-C18 olefin-maleic acid copolymer, an organic solvent, a surfactant, and water, and wherein the recording ink contains a colorant, an organic solvent, a surfactant, and water.

The present invention can solve the aforementioned various problems in the art, and can provide an image forming method, which has high adaptability to a recording medium, and form a high quality image having excellent abrasion resistance without causing beading even when a recording medium of low absorbency is used, such as coated paper used in commercial printing.

Figure 1:
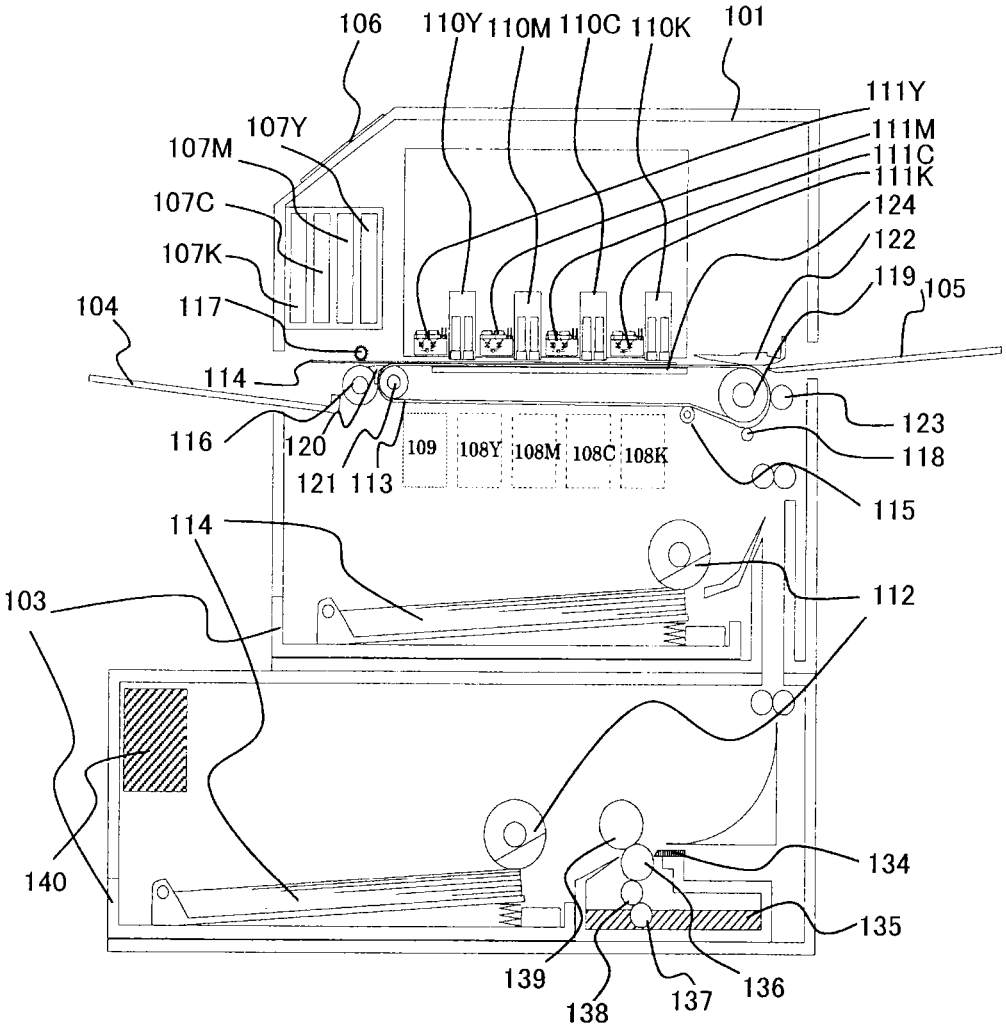
FIG. 1 is a schematic side view illustrating one example of an image forming apparatus used for the image forming method of the present invention.

DETAILED DESCRIPTION OF THE INVENTION (Image Forming Method and Image Forming Apparatus)

The image forming method of the present invention include a treatment liquid applying step, and a recording ink applying step, and may further contain other steps, if necessary.

The image forming apparatus of the present invention contains a treatment liquid applying unit, and a recording ink applying unit, and may further contain other units, if necessary.

<Treatment Liquid Applying Step and Treatment Liquid Applying Unit>

The treatment liquid applying step is applying a treatment liquid onto a recording medium, and is performed by a treatment liquid applying unit.

<<Treatment Liquid>>

The treatment liquid for use in the image forming method of the present invention contains a cationic resin having a cationic degree of 5 or higher, nonionic polyacryl amide, an alkali salt of a C12-C18 olefin-maleic acid copolymer, an organic solvent, a surfactant, and water, and may further contain other components, if necessary.

—Cationic Resin—

The cationic resin forms aggregates of a colorant in a recording ink with electric action between the cationic resin and the colorant to separate the colorant from a liquid phase, to thereby accelerate fixing onto a recording medium. As the treatment liquid contains the cationic resin having a cationic degree of 5 or higher with high concentration, an amount of a treatment liquid for use can be reduced, curling or beading can be prevented even when a recording medium of low ink absorbency is used, and a high quality image can be formed.

The cationic degree indicate the strength of cationy, and the higher value of the cationic degree indicate the higher cationy.

The cationic degree is determined by colloidal titration using a polyvinyl potassium sulfate reagent. Specifically, the cationic degree can be determined in the following manner. Deionized water (90 mL) is placed in a conical beaker, and to the water, 10 mL of a 500 ppm sample (dry conversion) aqueous solution is added. The pH of the resultant is adjusted to pH 4.0 with a hydrochloric acid solution, and the resulting mixture is stirred for about 1 minute. Next, two or three drops of a toluidine blue indicator are added, and titration is performed with N/400 polyvinyl potassium sulfate reagent (N/400PVSK). The titration speed is set to 2 mL/min, and the titration is terminated when a color of the test water is maintained for 10 seconds or longer after turning the color of the test water from blue into reddish violet.

The cationic degree is determined with the following equation.

Cationic degree (meq/g)=(titer of *N*/400*PVSK*)×(potency of *N*/400*PVSK*)/2

As for the cationic resin, any of cationic resins used for conventional inkjet recording inks can be used. However, the cationic resin is preferably a cationic resin containing a structural unit represented by the following general formula (1) or (2).

General Formula (1)

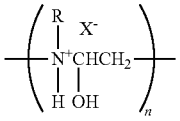

In the general formula (1), $X^-$ is an anionic counter ion, R is an alkyl group, and n is an integer of 10 to 13.

General Formula (2)

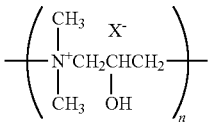

In the general formula (2), $X^-$ is an anionic counter ion, and n is an integer of 10 to 13.

The cationic resin may be appropriately synthesized for use, or selected from commercial products. Examples of the commercial product thereof include DK6810 manufactured by SEIKO PMC CORPORATION, and Catiomaster PDT-2, and PD-30, manufactured by Yokkaichi Chemical Company, Limited.

An amount of the cationic resin in the treatment liquid is preferably 1% by mass to 60% by mass, more preferably 5% by mass to 50% by mass, and even more preferably 30% by mass to 40% by mass.

When the amount of the cationic resin is less than 1% by mass, an effect of aggregating a colorant on a surface of a recording medium becomes low, which increases an amount of the treatment liquid for use. As a result, it takes a long time for a liquid phase to penetrate into the recording medium, and especially in the case where a recording medium of low ink absorbency is used, it is difficult to prevent beading. When the amount of the cationic resin is greater than 60% by mass, an effect of aggregating a colorant becomes too high, problems, such as insufficient filling in a solid image area, may be caused.

—Nonionic Polyacryl Amide—

The nonionic polyacryl amide is used mainly for the purpose of fixing a recording ink onto a surface of a recording medium with physical actions.

Specifically, the nonionic polyacryl amide adsorbs associations of a colorant and the cationic resin, and increases sizes of the associations or aggregations of the colorant to retain them on a surface of a recording medium, so that only a liquid component of the recording ink is promptly absorbed into the recording medium. As a result, beading is prevented, as well as improving abrasion resistance.

The nonionic polyacryl amide receives less influence of hydrolysis by water in the treatment liquid compared to cationic polyacryl amide or amphoteric acryl amide, and therefore the treatment liquid using the nonionic polyacryl amide has excellent shelf stability, and can form a high quality image over a long period.

The nonionic polyacryl amide may be appropriately synthesized for use, or selected from commercial products. Examples of the commercial product thereof include Haricoat 1057 manufactured by Harima Chemicals Group, Inc., and DR6912 manufactured by SEIKO PMC CORPORATION.

The weight average molecular weight of the nonionic polyacryl amide is preferably several hundred thousands to several ten millions, more preferably 500,000 to 5,000,000. When the weight average molecular weight of the nonionic polyacryl amide is excessively small, the physical actions thereof on a surface of a recording medium are impaired. When the weight average molecular weight thereof is excessively large, a viscosity of a resulting treatment liquid becomes too high.

An amount of the nonionic polyacryl amide in the treatment liquid is preferably 0.01% by mass to 5% by mass, more preferably 0.1% by mass to 3% by mass. When the amount of the nonionic polyacryl amide is less than 0.01% by mass, physical actions thereof on a surface of a recording medium are impaired. When the amount thereof is greater than 5% by mass, a viscosity of a resulting treatment liquid becomes too high.

—Alkali Salt of C12-C18 Olefin-Maleic Acid Copolymer—

The alkali salt of the copolymer is an alkali salt obtained by affecting a copolymer, which is obtained through a reaction between C12-C18 olefin and maleic acid, with an alkali aqueous solution.

Examples of the C12-C18 olefin include 1-dodecene, 1-tridecene, 1-tetradecene, 1-pentadecene, 1-hexadecene, 1-heptadecene, and 1-octadecene. Examples of the maleic acid include maleic acid and a salt thereof, maleic anhydride, maleic acid monoester and a salt thereof. Moreover, examples of the alkali aqueous solution include alkali aqueous solutions of sodium hydroxide, potassium hydroxide, and ammonium.

The alkali salt of the copolymer for use in the present invention preferably has the weight average molecular weight of 1,000 to 100,000.

An amount of the alkali salt of the copolymer is preferably less than 10% by mass relative to the amount of the nonionic polyacryl amide.

—Organic Solvent—

Examples of the organic solvent include polyhydric alcohol, polyhydric alcohol alkyl ether, polyhydric alcohol aryl ether, a nitrogen-containing heterocyclic compound, amide, amine, a sulfur-containing compound, propylene carbonate, and ethylene carbonate.

Examples of the polyhydric alcohol include glycerin, 1,3-butanediol, 3-methyl-1,3-butanediol, 1,5-pentanediol, 1,6-hexanediol, ethylene glycol, diethylene glycol, triethylene glycol, tetraethylene glycol, polyethylene glycol, propylene glycol, dipropylene glycol, tripropylene glycol, polypropylene glycol, hexylene glycol, trimethylol ethane, trimethylol propane, 1,2,3-butanetriol, 1,2,4-butanetriol, 1,2,6-hexanetriol, and 3-methyl-1,3,5-pentanetriol.

Examples of the polyhydric alcohol alkyl ether include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Examples of the polyhydric alcohol aryl ether include ethylene glycol monophenyl ether, and ethylene glycol monobenzyl ether.

Examples of the amine include monoethanol amine, diethanol amine, triethanol amine, monoethyl amine, diethyl amine, and triethyl amine.

Examples of the sulfur-containing compound include dimethyl sulfoxide, sulfolane, and thiodiethanol.

Among these organic solvents, particularly preferred are glycerin, diethylene glycol, 1,3-butanediol, and 3-methyl-1,3-butanediol. These organic solvents exhibit excellent effects on solubility, and prevention of jet failures caused by moisture evaporation. Moreover, use of these organic solvents can realize formation of a treatment liquid having excellent storage stability and ejection stability.

—Surfactant—

The functions of the surfactant include reducing surface tension of the treatment liquid, improving wettability of the treatment liquid to various recording media, and to achieving coating of the treatment liquid without any unevenness. By giving appropriate wettability, a penetration speed of the treatment liquid to various recording media can be increased, and as a result, problems in fixing or bleeding can be prevented.

Especially, the penetration of the treatment liquid to various recording media is very important. If the penetration of the treatment liquid is insufficient, a large amount of the treatment liquid is retained adjacent to a surface of a recording medium. As a result, when the treatment liquid is brought into contact with a colorant contained a recording ink, the colorant is aggregated in an excessive degree to reduce a diameter of a dot, to thereby cause insufficient filling of a solid image. In addition, as an excessive amount of the colorant component is retained on the surface of the recording medium, a problem, such as low fixing ability (abrasion resistance) may be caused.

Examples of the surfactant include a fluorosurfactant, a nonionic surfactant, an anionic surfactant, amphoteric surfactant, and a silicone-based surfactant. In the present invention, a surfactant capable of reducing a surface tension with a small amount thereof is preferable in order to make a concentration of the cationic resin high. Use of a fluorosurfactant or polyoxyalkylene alkyl ether is preferable.

As for the fluorosurfactant, more preferred is a fluorosurfactant represented by the following general formula (3), which does not contain PFOS (perfluorooctane sulfonate) and PFOA (perfluorooctanoic acid), in view of a possible environmental pollution.

$$C_nF_{2n+1}—CH_2CH(OH)CH_2O—(CH_2CH_2O)_a—Y \quad \text{General Formula (3)}$$

In the general formula (3), n is an integer of 2 to 6; a is an integer of 15 to 50; and Y is $—C_bH_{2b+1}$ (provided that b is an integer of 11 to 19), or $CH_2CH(OH)CH_2—C_mF_{2m+1}$ (provided that m is an integer of 2 to 6). Examples of the fluorosurfactant include compounds represented by the following structural formulae.

$$C_4F_9—CH_2CH(OH)CH_2O—(CH_2CH_2O)_{23}—CH_2CH(OH)CH_2O—C_4F_9$$

$$C_4F_9—CH_2CH(OH)CH_2O—(CH_2CH_2O)_{35}—CH_2CH(OH)CH_2O—C_4F_9$$

$$C_4F_9—CH_2CH(OH)CH_2O—(CH_2CH_2O)_{45}—CH_2CH(OH)CH_2O—C_4F_9$$

$$C_3F_7—CH_2CH(OH)CH_2O—(CH_2CH_2O)_{23}—CH_2CH(OH)CH_2O—C_3F_7$$

$$C_6F_{13}—CH_2CH(OH)CH_2O—(CH_2CH_2O)_{23}—CH_2CH(OH)CH_2O—C_6F_{13}$$

$$C_4F_9—CH_2CH(OH)CH_2O—(CH_2CH_2O)_{25}—C_{16}H_{33}$$

Among them, the fluorosurfactant represented by the following structural formula (1) is particularly preferable.

$$C_4F_9—CH_2CH(OH)CH_2O—(CH_2CH_2O)_{23}—CH_2CH(OH)CH_2O—C_4F_9 \quad \text{Structural Formula (1)}$$

Other examples of the fluorosurfactant include a perfluoroalkyl sulfonic acid compound, a perfluoroalkyl carboxylic acid compound, a perfluoroalkyl phosphoric acid ester compound, a perfluoroalkyl ethylene oxide adduct, and a polyoxyalkylene ether polymer compound having a perfluoroalkyl ether group at a side chain thereof. These may be used alone or in combination.

Examples of the perfluoroalkyl sulfonic acid compound include perfluoroalkyl sulfonic acid, and perfluoroalkyl sulfonic acid salt.

Examples of the perfluoroalkyl carboxylic acid compound include perfluoroalkyl carboxylic acid, and perfluoroalkyl carboxylic acid salt.

Examples of the perfluoroalkyl phosphoric acid ester compound include perfluoroalkyl phosphoric acid ester, and a salt of perfluoroalkyl phosphoric acid ester.

Examples of the polyoxyalkylene ether polymer compound having a perfluoroalkyl ether group at a side chain thereof include a sulfuric acid ester salt of a polyoxyalkylene ether polymer having a perfluoroalkyl ether group at a side chain thereof, and a salt of a polyoxyalkylene ether polymer having a perfluoroalkyl ether group at a side chain thereof.

Examples of a counter ion of a salt in the fluorosurfactant include Li, Na, K, $NH_4$, $NH_3CH_2CH_2OH$, $NH_2(CH_2CH_2OH)_2$, and $NH(CH_2CH_2OH)_3$.

The fluorosurfactant is not particularly limited, and may be appropriately synthesized for use, or selected from commercial products. Examples of the commercial product thereof include: SURFLON series (S-111, S-112, S-113, S-121, S-131, S-132, S-141, S-145) manufactured by Asahi Glass Co., Ltd.; FLOURAD series (FC-93, FC-95, FC-98, FC-129, FC-135, FC-170C, FC-430, FC-431) manufactured by Sumitomo 3M limited; MEGAFACE series (F-470, F-1405, F-474) manufactured by DIC Corporation; Zonyl TBS, FSP, FSA, FSN-100, FSN, FSO-100, FSO, FS-300, UR, all manufactured by Du Pont Kabushiki Kaisha; FT-110, FT-250, FT-252, FT-400S, FT-150, FT-400SW, all manufactured by NEOS COMPANY LIMITED; and PF-151N manufactured by Omnova Solutions, Inc.

Examples of the nonionic surfactant include an acetylene glycol-based surfactant, polylxyethylene alkyl ether, polyoxyethylene alkyl phenyl ether, polyoxyethylene alkyl ester, and polyoxyethylene sorbitan fatty acid ester.

Examples of the acetylene glycol-based surfactant include 2,4,7,9-tetramethyl-5-decine-4,7-diol, 3,6-dimethyl-4-octine-3,6-diol, and 3,5-dimethyl-1-hexine-3-ol. Examples of a commercial product of the acetylene glycol-based surfactant include SURFYNOL series (104, 82, 465, 485, TG) manufactured by Air Products and Chemicals, Inc.

Examples of the anionic surfactant include polylxyethylene alkyl ether acetic acid salt, dodecylbenzene sulfonic acid salt, succinic acid ester sulfonic acid salt, lauric acid salt, and a salt of polylxyethylene alkyl ether sulfate.

Examples of the amphoteric surfactant include laurylaminopropionic acid salt, lauryl dimethyl betaine, stearyl dimethyl betaine, lauryl dihydroxyethyl betaine, lauryl dimethyl amine oxide, myristyl dimethyl amine oxide, stearyl dimethyl amine oxide, dihydroethyl lauryl amine oxide, polyoxyethylene coconut oil alkyldimethyl amine oxide, dimethylalkyl (coconut oil) betaine, and dimethyl lauryl betaine. Examples of a commercial product of the amphoteric surfactant include those readily available from Nikko Chemicals Co., Ltd., Nihon Emulsion Co., Ltd., Nippon Shokubai Co., Ltd., TOHO Chemical Industry Co., Ltd., Kao Corporation, ADEKA CORPORATION, Lion Corporation, AOKI OIL INDUSTRIAL CO., LTD., and Sanyo Chemical Industries, Ltd.

The silicone-based surfactant is appropriately selected depending on the intended purpose without any limitation. Among them, preferred is a silicone-based surfactant that is not decomposed at high pH. Examples thereof include side chain-modified polydimethylsiloxane, both terminals-modified polydimethylsiloxane, one terminal-modified polydimethylsiloxane, and side chain and both terminals-modified polydimethylsiloxane. The silicone-based surfactant having, as a modified group, a polyoxyethylene group, or a polyoxyethylene polyoxypropylene group is particularly preferable because it has excellent properties as an aqueous surfactant.

The silicone-based surfactant may be appropriately synthesized for use, or selected from commercial products. As for the commercial products thereof, for example, those manufactured by BYK Japan K. K., Shin-Etsu Chemical Co., Ltd., and Dow Corning Toray Co., Ltd. are readily available.

As for the silicone-based surfactant, moreover, a polyether-modified silicone-based surfactant may be used. Examples of the polyether-modified silicone-based surfactant include a compound in which a polyalkylene oxide structure is introduced to a side chain from Si of dimethyl polysiloxane.

The polyether-modified silicone compound may be appropriately selected for use or selected from commercial products. Examples of the commercial product thereof include KF-618, KF-642, and KF-643 manufactured by Shin-Etsu Chemical Co., Ltd.

In case of the fluorosurfactant represented by the general formula (3), an amount of the surfactant in the treatment liquid for use in the present invention is preferably 0.01% by mass to 4% by mass, more preferably 0.1% by mass to 1% by mass.

In the case where the surfactant is polyoxyalkylene alkyl ether, the amount of the surfactant in the treatment liquid is preferably 0.5% by mass to 3% by mass, more preferably 1% by mass to 2% by mass.

—Water—

Examples of the water include pure water, or ultra-pure water, such as ion-exchanged water, ultrafiltered water, Milli-Q water, and distilled water.

An amount of the water in the treatment liquid is preferably 60% by mass or smaller, more preferably 30% by mass to 50% by mass. When the amount of the water is excessively large, viscosity increase, gelation, and insoluble matter precipitation of the treatment liquid occur, as the water is evaporated.

—Other Components—

Other components are appropriately selected depending on the intended purpose without any limitation. Examples thereof include a defoaming agent, a pH regulator, an antiseptic/antifungal agent, a chelating reagent, an anti-rust agent, an antioxidant, an ultraviolet absorber, an oxygen absorber, and a photostabilizer.

——Defoaming Agent——

The treatment liquid may contain a defoaming agent for preventing unevenness of coating due to air bubbles.

As for the defoaming agent, any of defoaming agents used for a conventional recording ink, such as a silicone-based defoaming agent, can be used. However, the defoaming agent is preferably a surfactant, which has high surface activation performance and can reduce surface tension with a small amount thereof, is preferable. Especially when the fluorosurfactant represented by the general formula (1) is used in the treatment liquid, the defoaming agent is preferably a defoaming agent selected from the group consisting of N-octyl-2-pyrrolidone, 2,4,7,9-tetramethyldecane-4,7-diol, and 2,5,8,11-tetramethyldodecane-5,8-diol for inhibiting generation of air bubbles.

An amount of the defoaming agent varies depending on a recording medium or surfactant for use, but the amount thereof is preferably 1.5 parts by mass or greater, more preferably 2 parts by mass to 4 parts by mass, relative to 1 part by mass of the surfactant.

——pH Regulator——

In the case where the treatment liquid is acidic, such treatment liquid may corrode a metal member of a coating device. In order to prevent various problems caused during use over a long period, the treatment liquid can contain a pH regulator therein.

Examples of the pH regulator include 2-amino-2-methyl-1,3-propane diol, and 2-amino-2-ethyl-1,3-propane diol. It is preferred that an amount of the pH regulator be appropriately selected so that pH of the treatment liquid is 4 to 8.

——Antibacterial Agent——

Examples of the antibacterial agent include sodium dehydrosulfate, sodium sorbate, sodium-2-pyridinethiol-1-oxide, sodium benzoate, and sodium pentachlorophenol.

——Chelating Reagent——

Examples of the chelating reagent include sodium ethylenediamine tetraacetate, sodium nitrilotriacetate, sodium hydroxyethylethylene diamine triacetate, sodium diethylene triamine pentaacetate, and sodium uramildiacetate.

——Anti-Rust Agent——

Examples of the anti-rust agent include acidic sulfite salt, sodium thiosulfate, ammonium thiodiglycolate, diisopropyl ammonium nitrite, pentaerythritol tetranitrate, and dicyclohexyl ammonium nitrite.

——Antioxidant——

Examples of the antioxidant include a phenol-based antioxidant (including a hindered phenol-based antioxidant), an amine-based antioxidant, a sulfur-based antioxidant, and a phosphorous-based antioxidant.

The physical properties of the treatment liquid are appropriately selected depending on the intended purpose without any limitation. For example, the viscosity, surface tension, and pH of the treatment liquid are preferably within the following ranges.

The viscosity of the treatment liquid at 25° C. is preferably 0.5 mPa·s to 30 mPa·s.

The viscosity of the treatment liquid can be measured, for example, by means of a viscometer (RE-550L: manufactured by Toki Sangyo Co., Ltd.).

The surface tension of the treatment liquid at 25° C. is preferably 45 mN/m or lower, more preferably 40 mN/m or lower.

The pH of the treatment liquid is, for example, preferably 4 to 12.

As for a method for applying the treatment liquid onto the recording medium, for example, a liquid ejecting system, and a coating system can be used.

The liquid ejecting system is appropriately selected depending on the intended purpose without any limitation. As for a driving system of an ejection head, an on-demand head utilizing a piezoelectric element actuator using PZT etc., a system for applying thermal energy, or an actuator using electrostatic force, or a continuous-jet charge controlled head may be used.

Examples of the coating method include blade coating, gravure coating, gravure offset coating, wire bar coating, bar coating, roller coating, knife coating, air knife coating, comma coating, U-comma coating, AKKU coating, smoothing coating, microgravure coating, reverse roller coating, four-roller or five-roller coating, dip coating, curtain coating, slide coating, and die coating. Among them, wire bar coating and roller coating are particularly preferable.

The coating step may be performed on a recording medium surface of which is completely dried, or on a recording medium on which an image is formed and is being dried. In both cases, the coating step exhibits it effect. Note that, a drying step can be optionally provided to a recording medium to which the treatment step has been performed. In this case, the recording medium can be dried by a roller heater, drum heater, or hot air. The drying temperature is preferably 60° C. or higher.

A coating amount of the treatment liquid onto the recording medium in the treatment step is preferably 0.1 g/m$^2$ to 30.0 g/m$^2$, more preferably 0.2 g/m$^2$ to 10.0 g/m$^2$.

When the coating amount is smaller than 0.1 g/m$^2$, improvement in image quality may be hardly attained. When the coating amount thereof is greater than 30.0 g/m$^2$, especially in case of a recording medium of low ink absorbency, drying of the treatment liquid is impaired, and therefore curling of the recording medium may be caused.

<Recording Ink Applying Step and Recording Ink Applying Unit>

The recording ink applying step is applying a recording ink onto the recording medium, and is performed by a recording ink applying unit.

<<Recording Ink>>

The recording ink contains a colorant, an organic solvent, a surfactant, and water, preferably further contains a carboxyl group-containing resin, and may further contain other components, if necessary.

—Colorant—

The colorant is used for coloring a recording ink and improving an image density of a resulting image. The colorant is appropriately selected from conventional pigments or dyes depending on the intended purpose without any limitation, but it is preferably a pigment containing an anionic group, or a pigment or dye covered with a resin containing an anionic group.

The pigment may be an inorganic pigment or an organic pigment. The pigment may be used alone, or in combination. Note that, the recording ink may contain a dye in combination with the pigment for the purpose of controlling a color tone, but it is important to pay attention not to impair weather fastness.

Examples of the inorganic pigment include titanium oxide, iron oxide, calcium carbonate, barium sulfate, aluminum hydroxide, barium yellow, cadmium red, chrome yellow, and carbon black. Among them, carbon black is particularly preferable.

Examples of the carbon black include those produced by conventional methods, such as a contact method, a furnace method, and a thermal method.

Examples of the organic pigment include an azo pigment, a polycyclic pigment, dye chelate, a nitro pigment, a nitroso pigment, and aniline black. Among them, preferred are an azo pigment, and a polycyclic pigment.

Examples of the azo pigment include azo lake, an insoluble azo pigment, a condensed azo pigment, and a chelate azo pigment. Examples of the polycyclic pigment include a phthalocyanine pigment, a perylene pigment, a perinone pigment, an anthraquinone pigment, a quinacridon pigment, a dioxazine pigment, an indigo pigment, a thioindigo pigment, an iso-indolinone pigment, and a quinophtharone pigment. Examples of the dye chelate include basic dye chelate, and acid dye chelate.

A color of the colorant is appropriately selected depending on the intended purpose without any limitation, and examples thereof include a colorant for black, and a colorant for colors. These may be used alone, or in combination.

Examples of the colorant for black include: carbon black (C.I. PIGMENT BLACK 7) such as furnace black, lamp black, acetylene black, and channel black; metals such as copper, iron (C.I. PIGMENT BLACK 11), and titanium oxide; and organic pigments such as aniline black (C.I. PIGMENT BLACK 1).

Examples of the colorant for colors include: C.I. PIGMENT YELLOW 1, 3, 12, 13, 14, 17, 24, 34, 35, 37, 42 (yellow oxide), 53, 55, 74, 81, 83, 95, 97, 98, 100, 101, 104, 108, 109, 110, 117, 120, 128, 138, 150, 151, 153, 183; C.I. PIGMENT ORANGE 5, 13, 16, 17, 36, 43, 51; C.I. PIGMENT RED 1, 2, 3, 5, 17, 22, 23, 31, 38, 48:2, 48:2 (permanent red 2B(Ca)), 48:3, 48:4, 49:1, 52:2, 53:1, 57:1 (brilliant carmine 6B), 60:1, 63:1, 63:2, 64:1, 81, 83, 88, 101 (red ocher), 104, 105, 106, 108 (cadmium red), 112, 114, 122 (quinacridon magenta), 123, 146, 149, 166, 168, 170, 172, 177, 178, 179, 185, 190, 193, 209, 219; C.I. PIGMENT VIOLET 1 (rhodamine lake), 3, 16, 19, 23, 38; C.I. PIGMENT BLUE 1, 2, 15 (phthalocyanine blue), 15:1, 15:2, 15:3 (phthalocyanine blue), 16, 17:1, 56, 60, 63; and C.I. PIGMENT GREEN 1, 4, 7, 8, 10, 17, 18, and 36.

As for the colorant, a polymer emulsion in which a pigment is contained in polymer particles is preferably used.

The polymer emulsion, in which the pigment is contained in the polymer particles, is the one in which the pigment is encapsulated in the polymer particles, or the one in which the pigment is adsorbed on surfaces of the polymer particles. In this case, all of the pigment particles do not need to be encapsulated or adsorbed, and par thereof may be dispersed in the emulsion as long as it does not impair an obtainable effect of the present invention.

Examples of the polymer for forming the polymer emulsion (the polymer of the polymer particles) include vinyl-based polymer, polyester-based polymer, and polyurethane-based polymer. Among them, vinyl-based polymer and polyester-based polymer are preferable. Those disclosed in Japanese Patent Application (JP-A) Nos. 2000-53897 and 2001-139849 can be used as the polymer.

Moreover, colorant particles, in each of which an inorganic particle is covered with an organic pigment or carbon black, may be used.

Examples of a method for covering the inorganic particles with carbon black include: liquid drying using coagulation or precipitation; and dry mixing where mechanical force is applied with mixing. Moreover, examples of a method for covering the inorganic particles with an organic pigment include: a method in which the organic pigment is precipitated in the presence of the inorganic particles; and a method in which the inorganic particles and the organic pigment are mechanically mixed and ground.

For example, in the case where the inorganic particles are covered with an organic pigment having excellent thermal stability, chemical deposition may be used. Moreover, an organosilane compound layer formed of polysiloxane or alkyl silane may be optionally provided between the inorganic particle and the organic pigment. Use of the organosilane compound layer can improve adhesion between the inorganic particle and the organic pigment.

Examples of the inorganic particles include titanium dioxide, silica, alumina, iron oxide, iron hydroxide, and tin oxide. As for shapes of the inorganic particles, those having a small aspect ratio are preferable, spherical shapes are more preferable. In the case where a color colorant is adsorbed on surfaces of the inorganic particles, moreover, the inorganic particles are preferably colorless transparent or white. In the case where a black colorant is adsorbed, black inorganic particles may be used.

The primary particle diameter of the inorganic particles is preferably 100 nm or smaller, more preferably 5 nm to 50 nm.

As for the organic pigment covering the inorganic particles, examples of the black pigment thereof include carbon black, and aniline black. Examples of the color pigment thereof include anthraquinone, phthalocyanine blue, phthalocyanine green, diazo, monoazo, pyranthrone, perylene, heterocyclic yellow, quinacridon, and (thio)indigoid.

Among them, a phthalocyanine-based pigment, a quinacridon-based pigment, a monoazo yellow-based pigment, a disazo yellow-based pigment, and a heterocyclic yellow pigment are preferable in view of coloring ability thereof.

Examples of the phthalocyanine-based pigment include copper phthalocyanine blue and derivatives thereof (C.I. PIGMENT BLUE 15:3, 15:4), and aluminum phthalocyanine.

Examples of the quinacridon-based pigment include C.I. PIGMENT ORANGE 48, C.I. PIGMENT ORANGE 49, C.I. PIGMENT RED 122, C.I. PIGMENT RED 192, C.I. PIGMENT RED 202, C.I. PIGMENT RED 206, C.I. PIGMENT RED 207, C.I. PIGMENT RED 209, C.I. PIGMENT VIOLET 19, and C.I. PIGMENT VIOLET 42.

Examples of the monoazo yellow-based pigment include C.I. PIGMENT YELLOW 74, C.I. PIGMENT YELLOW 109, C.I. PIGMENT YELLOW 128, and C.I. PIGMENT YELLOW 151.

Examples of the disazo yellow-based pigment include C.I. PIGMENT YELLOW 14, C.I. PIGMENT YELLOW 16, and C.I. PIGMENT YELLOW 17.

Examples of the heterocyclic yellow-based pigment include C.I. PIGMENT YELLOW 117, and C.I. PIGMENT YELLOW 138.

A mass ratio (inorganic particle:colorant) of the inorganic particles to the colorant, which is an organic pigment or carbon black, is preferably 3:1 to 1:3, more preferably 3:2 to 1:2. When the ratio of the colorant is too small, coloring or tinting strength may be insufficient. When the ratio of the colorant is too large, transparency or color tone may be impaired.

As for the colorant particles in which the inorganic particles are covered with the organic pigment or carbon black, any of commercial products thereof can be used. Examples of the commercial product thereof include a silica/carbon black composite material, a silica/phthalocyanine C.I. PIGMENT BLUE 15:3 composite material, a silica/disazo yellow composite material, and a silica/quinacridon C.I. PIGMENT RED 122 composite material (all manufactured by TODA KOGYO CORPORATION).

In the case where inorganic particles having the primary particle diameter of 20 nm are covered with an equal amount of an organic pigment, the primary diameter of resulting colorant particles is about 25 nm. If such colorant particles can be dispersed in the state of primary particles using an appropriate dispersant, a very fine pigment dispersed ink having a dispersed particle diameter of 25 nm can be produced.

The primary particle diameter of the colorant particles in the recording ink is preferably 5 nm to 100 nm, more preferably 30 nm to 80 nm. When the primary particle diameter thereof is smaller than 5 nm, the recording ink may increase its viscosity or colorant particles therein may be aggregated after storage of lone period. When the primary particle diameter thereof is greater than 100 nm, in the case where a recording ink is printed on a recording medium, such as paper, and a film, a resulting print may have a printed area where color saturation and color value are low.

Note that, the primary particle diameter of the colorant particles means the minimum unit of the colorant particles which cannot be made any finer by mechanical shearing.

An amount of the colorant in the recording ink is appropriately selected depending on the intended purpose without any limitation, but the amount thereof is preferably 1% by mass to 20% by mass, more preferably 2% by mass to 15% by mass.

—Organic Solvent—

The recording ink contains an organic solvent for the purpose of preventing the ink from drying, and improving dispersion stability of the ink.

Examples of the organic solvent include polyhydric alcohol, polyhydric alcohol alkyl ether, polyhydric alcohol aryl ether, a nitrogen-containing heterocyclic compound, amide, amine, a sulfur-containing compound, propylene carbonate, and ethylene carbonate. These may be used alone or in combination.

Examples of the polyhydric alcohol include glycerin, 1,3-butanediol, 3-methyl-1,3-butanediol, 1,5-pentanediol, 1,6-hexanediol, ethylene glycol, diethylene glycol, triethylene glycol, tetraethylene glycol, polyethylene glycol, propylene glycol, dipropylene glycol, tripropylene glycol, polypropylene glycol, hexylene glycol, trimethylol ethane, trimethylol propane, 1,2,3-butanetriol, 1,2,4-butanetriol, 1,2,6-hexanetriol, and 3-methyl-1,3,5-pentanetriol.

Examples of the polyhydric alcohol alkyl ether include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Examples of the polyhydric alcohol aryl ether include ethylene glycol monophenyl ether, and ethylene glycol monobenzyl ether.

Examples of the nitrogen-containing heterocyclic compound include 2-pyrrolidone, N-methyl-2-pyrrolidone, N-hydroxyethyl-2-pyrrolidone, 1,3-dimethylimidazolidinone, ϵ-caprolactam, and γ-butyrolactone.

Examples of the amine include monoethanol amine, diethanol amine, triethanol amine, monoethylamine, diethylamine, and triethylamine.

Examples of the sulfur-containing compound include dimethyl sulfoxide, sulfolane, and thiodiethanol.

Among them, glycerin, and 1,3-butanediol are particularly preferable. These organic solvents exhibit excellent solubility, and an excellent effect of preventing jetting failures, which may be caused by evaporation of moisture. Moreover, use of these organic solvents achieve production of a recording ink having excellent shelf stability and ejection stability.

For the recording ink, other than the organic solvent, saccharides or a derivative thereof may be optionally used in combination.

The saccharides are used mainly for the purpose of improving drought resistance, and examples thereof include monosaccharides, disaccharides, oligosaccharides (including trisaccharides, tetrasaccharides), polysaccharides, and derivatives thereof. Specific examples thereof include glucose, mannose, fructose, ribose, xylose, trahalose, and maltotriose. In the present specification, the polysaccharides mean sugar in the broad sense, and include materials widely present in the nature, such as α-cyclodextrin, and cellulose.

Examples of the derivatives of the saccharides include reducing sugars of saccharides, and oxidized sugar. Among them, sugar alcohol is preferable, and examples of the sugar alcohol include maltitol, and sorbitol.

An amount of the organic solvent is preferably 1% by mass to 40% by mass, more preferably 5% by mass to 30% by mass, relative to the recording ink.

—Surfactant—

Examples of the surfactant include a fluorosurfactant, a nonionic surfactant, an anionic surfactant, an amphoteric surfactant, and a silicone-based surfactant. As for the surfactant, any of the surfactants that can be used for the treatment liquid can be used also for a recording ink, but the surfactant used in the recording ink is preferably a fluorosurfactant. These surfactants may be used alone or in combination. In the case where a surfactant is not easily dissolved in a recording ink as it is used alone, there is a case that such surfactant can be dissolved by mixing with a plurality of surfactants, and can be stably present in the recording ink.

An amount of the fluorosurfactant in the recording ink is preferably 0.01% by mass to 4% by mass, more preferably 0.1% by mass to 1% by mass. When the amount thereof is less than 0.01% by mass, an effect obtainable by adding the fluorosurfactant may not be sufficiently exhibited. When the amount thereof is greater than 4% by mass, the recording ink may be penetrated into a recording medium more than necessary, which may cause low image density, or strike through.

—Carboxyl Group-Containing Resin—

The recording ink preferably contains a carboxyl group-containing resin. As the recording ink contains a carboxyl group-containing resin, the cationic resin in the treatment liquid and the carboxyl group-containing resin in the recording ink are reacted to each other to cause aggregation of a pigment serving as the colorant on a recording medium. As a result, the colorant is retained on a surface of the recording medium, and therefore image quality is improved, as well as improving abrasion resistance.

The carboxyl group-containing resin is appropriately selected depending on the intended purpose without any limitation, and examples thereof include a maleic acid resin, a styrene-maleic acid resin, a rosin-modified maleic acid resin, an alkyd resin, and a modified alkyd resin. These may be used alone, or in combination.

As for the carboxyl group-containing resin, a commercial product may be used. Examples of the commercial product thereof include: MALKYD series manufactured by Arakawa Chemical Industries, Ltd.; and HARIMACK series, and HARIPHTHAL series manufactured by Harima Chemicals Group, Inc.

As for an embodiment for adding the carboxyl group-containing resin, the carboxyl group-containing resin may be added in the state where a pigment serving as the colorant is encapsulated (microcapsulated) with the carboxyl group-containing resin, or the carboxyl group-containing resin may be added in the state where the colorant is dispersed in the carboxyl group-containing resin.

An amount of the carboxyl group-containing resin in the recording ink is preferably 0.5% by mass to 10% by mass, more preferably 1% by mass to 5% by mass.

—Water—

Examples of the water include pure water, or ultra-pure water, such as ion-exchanged water, ultrafiltered water, Milli-Q water, and distilled water.

An amount of the water in the recording ink is appropriately selected depending on the intended purpose without any limitation, but it is preferably 60 parts by mass or smaller, more preferably 30 parts by mass to 50 parts by mass, relative to 100 parts by mass of the recording ink.

When the amount of the water is greater than 60 parts by mass, the viscosity of the recording ink may be increased, the recording ink may cause gelation, or precipitate insoluble matter, as moisture in the recording ink is evaporated when the recording ink is applied onto a recording medium, or left to stand in a recording ink applying unit.

—Other Components—

In addition to the components mentioned above, the recording ink may optionally contain a penetrating agent, polymer particles, a defoaming agent, a pH regulator, an antibacterial agent, a chelating reagent, an anti-rust agent, an antioxidant, an ultraviolet absorber, an oxygen absorber, and a photostabilizer.

——Penetrating Agent——

The penetrating agent is in the state of a liquid at 25° C., and is a component having the higher boiling point than that of water. As for the penetrating agent, a C8-C11 polyol compound or a glycol ether compound is preferably used. These compounds have an effect of increasing a penetration speed towards a recording medium and an effect of preventing bleeding, and are partially water-soluble compounds each having a solubility of 0.1% by mass to 4.5% by mass in water of 25° C.

Examples of the C8-C11 polyol compound include 2-ethyl-1,3-hexanediol, 2,2,4-trimethyl-1,3-pentanediol, and 1,2-octanediol.

Examples of the glycol ether compound include a polyhydric alcohol alkyl ether compound, and a polyhydric alcohol aryl ether compound.

Examples of the polyhydric alcohol alkyl ether compound include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Examples of the polyhydric alcohol aryl ether compound include ethylene glycol monophenyl ether, and ethylene glycol monobenzyl ether. An amount of the penetrating agent in the recording ink is preferably 0.1% by mass to 10% by mass, more preferably 0.5% by mass to 5% by mass.

——Polymer Particles——

The polymer particles are preferably polymer particles having a film forming ability. Here, the film forming ability means characteristics that, when the polymer particles are dispersed in water in the form of an emulsion, a resin film is formed, as moisture of the aqueous emulsion is evaporated.

When the recording ink contains the polymer particles, the polymer particles form a film as a volatile component in the recording ink is evaporated. As a result, the colorant in the recording ink is strongly adhered onto a recording medium, and therefore an image having excellent abrasion resistance and water resistance can be realized.

Since the polymer particles form a film at room temperature, the polymer particles are preferably polymer particles having the minimum film forming temperature of 30° C. or lower, more preferably 10° C. or lower.

Here, the minimum film forming temperature means the minimum temperature at which a clear continuous film is formed when a polymer emulsion obtained by dispersing the polymer particles in water is thinly flow casted on a metal plate, such as aluminum, and temperature is increased.

As for the polymer particles, those having a single-particle structure can be used. For example, an alkoxysilyl group is contained in an emulsion particle, the alokoxysilyl group is brought into moisture remained, as fusion of emulsion particles due to moisture evaporation in the process of forming a coating film, to thereby cause hydrolysis and form a silanol group. As a silanol group is remained, moreover, the alkoxysilyl group or silanol group are reacted to another to form a rigid crosslink structure formed of a siloxane bond.

In the manner as described, when a reactive functional group is present in the polymer particle, a network structure can be formed during formation of a film by reacting the functional groups, without adding a curing agent.

Moreover, it is also possible to use polymer particles having a core-shell structure containing a core and a shell covering the core. Here, the core-shell structure means an embodiment where two or more polymers each having a different composition are present in a particle in the state of phase separation.

Accordingly, the core-shell structure is not necessarily an embodiment in which a core is completely covered with a shell, but also includes an embodiment in which part of the core is covered with the shell. Moreover, the core-shell structure may include an embodiment where part of the polymer of the shell forms domains in the core particle, and an embodiment having a multi-layer structure formed of three or more layers, in which one or more layers having a different composition is provided between the core and the shell.

The polymer particles can be obtained by a conventional method, such as by emulsifying and polymerizing a unsaturated vinyl monomer (unsaturated vinyl polymer) in water in the presence of a polymerization catalyst, and a emulsifying agent. Examples of the polymer particles include Landi PL series manufactured by MIYOSHI OIL & FAT CO., LTD.

The volume average particle diameter of the polymer particles is preferably 5 nm to 200 nm, more preferably 10 nm to 100 nm.

An amount of the polymer particles in the recording ink is preferably 0.5% by mass to 20% by mass, more preferably 1% by mass to 5% by mass.

When the amount thereof is less than 0.5% by mass, a function of improving abrasion resistance and water resistance may not be sufficiently exhibited. When the amount thereof is greater than 20% by mass, problems, such as jetting failures, may occur due to increased viscosity of the recording ink or fusion of the polymer particles caused by drying.

——pH Regulator——

The colorant particles (composite pigment particles) in which the inorganic particles are covered with the organic pigment or carbon black tend to be acidic when they are kneaded and dispersed in water together with an anionic dispersant. A surface of the composite pigment dispersed in a medium, such as water, is negatively charged, but a recording ink as a whole is acidic. Therefore, an inner area of the composite pigment is positively charged, and the negative charge on the surface of the particles is easily neutralized. In this state, the dispersed particles are aggregated, which becomes a cause for jetting failures. Therefore, it is preferred that the pH regulator be added to the recording ink to maintain the recording ink alkaline, to thereby stabilize the dispersion state and the jetting performance.

The pH regulator is preferably added to a kneaded dispersion liquid together with additives, such as a wetting agent, and a penetrating agent, rather than adding to water together with the pigment and the dispersing agent when the pigment and the dispersing agent are kneaded and dispersed in water. This is because the addition of the pH regulator may destroy the dispersion state, depending on a type of the pH regulator.

Examples of the pH regulator include alcohol amine, alkali metal hydroxide, ammonium hydroxide, phosphonium hydroxide, and alkali metal carbonate.

Examples of the alcohol amine include diethanol amine, triethanol amine, and 2-amino-2-ethyl-1,3-propane diol.

Examples of the alkali metal hydroxide include lithium hydroxide, sodium hydroxide, and potassium hydroxide.

Examples of the ammonium hydroxide include ammonium hydroxide, and quaternary ammonium hydroxide. Examples of the phosphonium hydroxide include quaternary phosphonium hydroxide.

Examples of the alkali metal carbonate include lithium carbonate, sodium carbonate, and potassium carbonate.

The pH of the recording ink is preferably 9 to 11. When the pH thereof is higher than 11, an amount of the material (such as of an ink supply unit) dissolved by the ink increases, which may cause deterioration or leakage of the recording ink, or jetting failures.

——Defoaming Agent——

As for the defoaming agent, a defoaming agent usable in the treatment liquid can be used.

An amount of the defoaming agent varies depending on a recording medium or surfactant for use, but the amount thereof is preferably 1.5 parts by mass or greater, more preferably 2 parts by mass to 4 parts by mass, relative to 1 part by mass of the surfactant.

As for the antibacterial agent, chelating reagent, anti-rust agent, and antioxidant, those same as ones used in the treatment liquid can be used.

<<Production of Recording Ink>>

The recording ink is produced by dispersing or dissolving, in water, an organic solvent, a colorant, a surfactant, and water, preferably a carboxyl group-containing resin, and other components, optionally followed by stirring and mixing.

The dispersing can be performed, for example, by a sand mill, a homogenizer, a ball mill, a paint shaker, or an ultrasonic disperser. The stirring and mixing can be performed by a typical stirrer having a stirring blade, a magnetic stirrer, or a high-speed disperse.

The physical properties of the recording ink are appropriately selected depending on the intended purpose without any limitation. For example, the viscosity, surface tension, and pH of the recording ink are preferably within the following ranges.

The viscosity of the recording ink at 25° C. is preferably 5 mPa·s to 25 mPa·s. By controlling the viscosity of the ink to 5 mPa·s or greater, an effect of improving print density, or quality of printed characters can be attained. By controlling the viscosity of the ink to 25 mPa·s or less, the desirable jetting performance can be secured.

The viscosity of the recording ink can be measured at 25° C. by means of a viscometer (RE-550L, manufactured by Toki Sangyo Co., Ltd.).

The surface tension of the recording ink at 25° C. is preferably 35 mN/m or lower, more preferably 32 mN/m or lower. When the surface tension of the recording ink is greater than 35 mN/m, leveling of the recording ink is hardly performed on a recording medium, which may increase the drying time.

The pH of the recording ink is, for example, preferably 7 to 12, and more preferably 8 to 11 in view of prevention of corrosion of a metal member that will be in contact with the recording ink.

A color of the recording ink is appropriately selected depending on the intended purpose without any limitation, and examples thereof include yellow, magenta, cyan, and black. When recording is performed using an ink set using two or more of these colors in combination, a multi-color image can be formed. When recording is performed using an inkset using all of these colors, a full-color image can be formed.

The ink applying unit contains an image forming unit configured to jet an ink on a surface of a recording medium to form an image, a retaining unit configured to retain a treatment liquid, and a treating unit configured to perform a treatment on the surface of the recording medium before or after the image formation performed by the image forming unit. Moreover, the image forming unit contains at least an ink jet unit, and may contain other units, such as a stimuli generating unit, and a controlling unit, if necessary.

FIG. 1 is a schematic diagram (side explanatory diagram) illustrating one example of the ink applying unit.

The ink applying unit 101 is equipped with head units (110K, 110C, 110M, 110Y) in each of which heads for ejecting a recording ink are accumulated, maintenance units (111K, 111C, 111M, 111Y) each corresponding to each head unit to perform a maintenance of heads, ink cartridges (107K, 107C, 107M, 107Y) for supplying an ink, and sub ink-tanks (108K, 108C, 108M, 108Y) for storing part of the ink supplied from the cartridge and supplying the ink to the head at an appropriate pressure.

The ink applying unit 101 further contains a discharging system including a convey belt 113 for suctioning a recording medium 114 by a suction fan 120 and conveying the recording medium 114, conveying rollers 119, 121, for supporting the convey belt 113, a tension roller 115 for controlling so that the convey belt 113 keeps an appropriate tension, a platen 124 and platen roller 118 for giving an appropriate flatness to the convey belt 113, a charging roller 116 for giving static charges so that the recording medium 114 is adhered, a discharging roller 117 for pressing the recording medium 114, and a discharging tray 104 for storing the discharged recording medium 114, and a feeding system including a feeding tray 103 for storing recording media 114 to be printed, separation pads 112 and 122 for sending the recording media 114 one by one from the feeding tray 103, a counter roller 123 for securely adhering the sent recording medium 114 to the charging belt, and a manual feeding tray 105 used in the case where paper is fed manually.

Moreover, the ink applying unit 101 is further equipped with a waste liquid tank 109 for collecting the waste liquid discharged after the maintenance, and a control panel 106 capable of displaying operating the devise and displaying the state of the device.

A nozzle array of each head unit is aligned so as to be orthogonal to the conveyance direction of the recording medium 114, and is formed so as to be longer than a length of a recording region. The recording media 114 stored in the feeding tray are separated into one piece by a separation roller, and the separated recording medium is fixed onto the convey belt by being pressed on the convey belt by a press roller. When the recording medium is passed under the head unit, the recording medium is patterned with droplets at high speed by jetting droplets to the recording medium. The recording medium is then separated from the convey belt by a separation craw, and discharged as a recorded matter into the discharging tray by a discharging roller and another discharging roller.

For this device, a coating system is provided as a system for treating a surface of a recording medium with a treatment liquid, and uses roller coating. The treatment liquid 135 is supplied from the treatment liquid storage tank 140 through a path (not illustrated), and taken out to a surface of a roller by a pumping roller 137, and is transferred to a film thickness controlling roller 138. The treatment liquid then transferred to the coating roller 136 is transferred to and applied to a recording medium 114 passed through between the coating roller 136 and the counter roller for coating 139.

The amount of the treatment liquid transferred to the coating roller 136 is controlled by adjusting the nip thickness with the coating roller 136. When an application of the treatment liquid is not desired, the treatment liquid present on the surface of the coating roller 136 can be scraped by pressing a movable blade 134 against the coating roller 136 so as not to leave the treatment liquid on the surface of the coating roller. In this manner, functional disorders caused by the residual treatment liquid on the coating roller 136 (e.g., increased viscosity due to the dried treatment liquid, bonding to the counter coating roller 139, and uneven application) can be prevented in advance.

Alternatively, as illustrated in FIG. 1, another coating mechanism may be employed where feeding sections are provided at the upper side and the bottom side respectively. In this mechanism, the bottom feeding section is used when the treatment liquid is coated, and the upper feeding section is used when the treatment liquid is not coated.

Other than the aforementioned roller coating, the treatment liquid can also be spray-coated by an inkjet system. For example, a head similar to the head unit 110K is charged with the treatment liquid, and the treatment liquid is ejected onto a recording medium 114 in the same manner as when the ink is ejected. In this manner, an amount of the treatment liquid to be ejected, and a position for ejection can be controlled easily, and highly precisely. Moreover, the roller coating and spray coating may be used in combination.

Whichever system is used, the treatment liquid can be applied to a desired position in a desired amount.

Furthermore, by heating the recording medium onto which the treatment liquid and the ink have been applied by a hot air fan 150, the drying is accelerated to thereby improve fixing ability. Note that, in the present invention, the heating step is performed on the recording medium after the printing by means of a hot blast fan. However, the heating step may be performed on the recording medium before or after the printing, and may be performed by other members, such as a heat roller, other than the hot blast fan.

Figure 3:
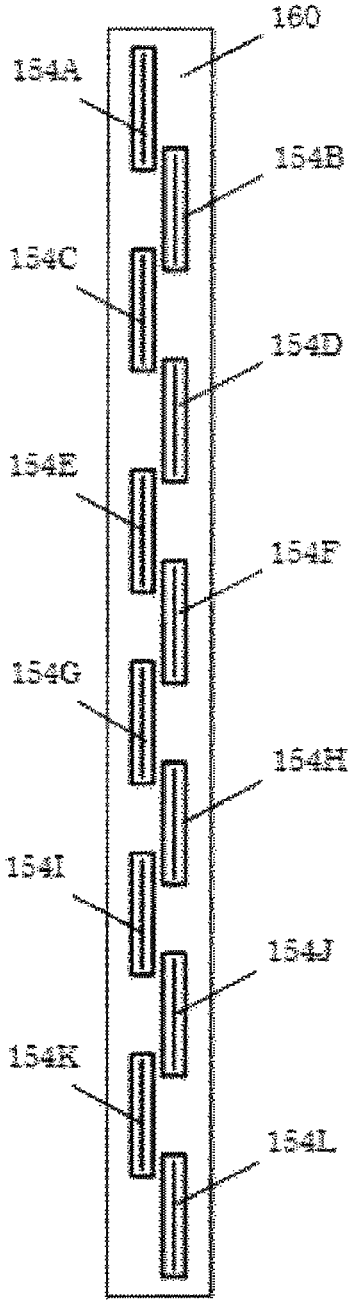
FIG. 3 is a schematic diagram illustrating one example of a head array in a head unit of an image forming apparatus used for the image forming method of the present invention.

FIG. 3 is a schematic diagram illustrating one example of head alignment of the head unit of the device for ejecting the liquid.

The head unit contains heads 154A to 154L fixed on the head circumferential member 160, and the heads are fixed with a staggered arrangement so that the heads overlap with part of nozzle.

Figure 4:
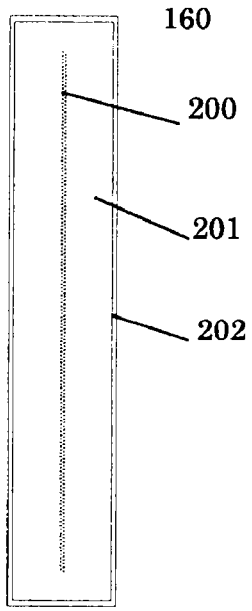
FIG. 4 is a schematic diagram illustrating a head aligned in the head unit of FIG. 3.

FIG. 4 is a schematic diagram illustrating heads aligned on the head unit of FIG. 3. Each head has a nozzle 200 which is two arrays of openings provided in a nozzle plate 201 in a staggered arrangement. The head and the head circumferential member are sealed with a filler 202 to remove any space from the side surface of the nozzle.

Next, outlines of the control unit of the device for ejecting a liquid illustrated in FIG. 1 are explained with reference to FIG. 2

Figure 2:
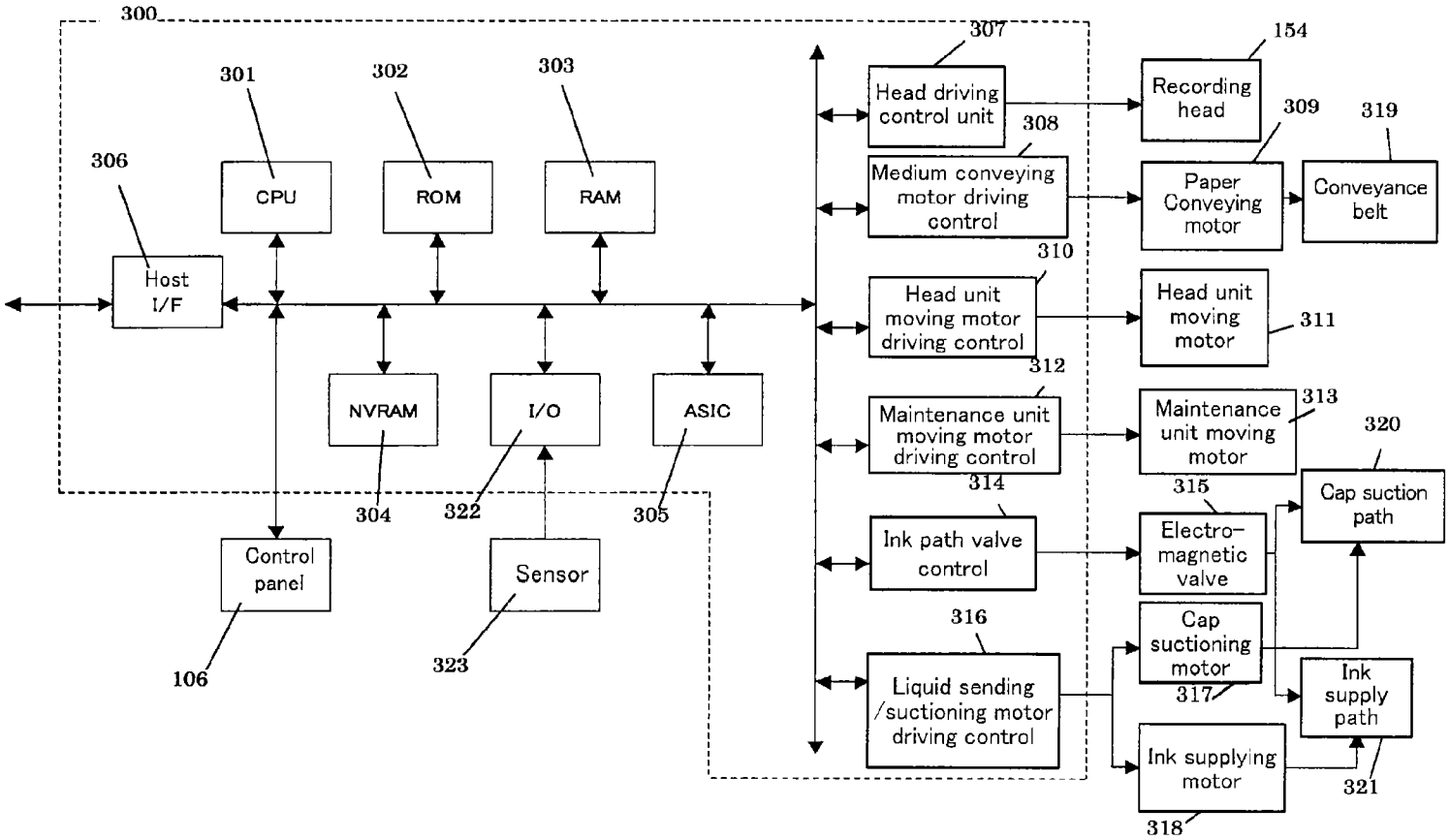
FIG. 2 is a schematic block diagram explaining a control section in FIG. 1.

Note that, FIG. 2 is a schematic block explanatory diagram of the control unit.

The control unit 300 contains: CPU 301 for controlling the entire device; ROM 302 for storing a program CPU 301 executes, and fixed data such as a value for a contamination degree of a nozzle surface relative to an ejection of the ink used in the present invention, a threshold value for the contamination degree of the nozzle surface, and data for a driving wave; RAM 303 for temporarily storing image data and the like; a nonvolatile memory (NVRAM) 304 for keeping data while a power source of the device is shut out; and ASIC 305 for processing input/output signals, such as various signals for the image data and image processing for replacing positions of images, and other input/output signals for controlling the entire device.

Moreover, the control unit 300 contains: a host I/F 306 for sending and receiving data and signals to and from a host; a head drive controlling unit 307 for generating a drive wave for driving and controlling a pressure generating unit of the recording head 154; a recording medium conveying motor driving unit 308 for driving a recording medium conveying motor 309; a head unit moving motor drive controlling unit 312 for driving a head unit (carriage) moving motor 311; an ink channel valve controlling unit 314 for controlling opening and closing of an electromagnetic valve 315 of an ink channel; a delivery/suction motor drive controlling unit 316 for controlling driving of a cap suction motor 317 or ink supplying motor 318; and I/O 322 for inputting detecting signals from an encoder which outputs a detecting signal corresponding to a traveling amount and speed of the conveyance belt 113, detecting signals from a sensor 323 for detecting temperature and humidity environment (or can be either of them), detecting signals on the ink level of each subtank, and detecting signals from various sensors not shown in the diagram.

The control unit 300 is connected to a control panel 106 to or on which information necessary to the device is input or displayed.

The control unit 300 receives at the host I/F 306 printing data and the like from a host via a cable or net, and in this case the host is such as an information-processing device (e.g., a personal computer), an image scanning device (e.g., an image scanner), and an imaging device (e.g., a digital camera).

CPU 301 reads out printing data into a receiving buffer contained in the host I/F 306 and analyzes the data, optionally makes the data to image-processed or repositioned by ASIC 305, synchronizes the image data (i.e. dot pattern data) which equivalent of one page for a head width of the recording head 154 with respect to a clock signal, and output the signal to the head drive controlling unit 307.

Then, CPU 301 reads out printing data in the receiving buffer contained in the host I/F 306 and analyzes it. After carrying out necessary image processing or repositioning of the data by ASIC 305, the image data is output to the head drive controlling unit 307. Note that, the formation of the dot pattern data for image output may be stored as font data in, for example, ROM 302. Alternatively, the image data may be expanded to bit map data by a printer driver at the host side, and the bit map data may be output to the device.

The head drive controlling unit 307 selectively applies voltage to a pressure generating unit of the recording head 154 based on the image data (i.e., the dot pattern data) for one page of the recording head 154 input per page, and drives the recording head 154.

Although it is not shown in the diagram, in the case where the treatment liquid is coated by a roller, a control unit of a motor for application, a motor to be controlled, and a sensor for controlling are provided in the device, as it is necessary to control driving of a group of rollers for application, such as an application roller.

Furthermore, in the case where the treatment liquid is applied by an inkjet method, there is a possibility to cause nozzle clogging due to mixing with other colors, unless the maintenance operation is performed in a different manner from that of the other inks. Therefore, it is desirable that a maintenance unit moving motor is provided for the treatment liquid, separately from that for the ink.

Figure 5:
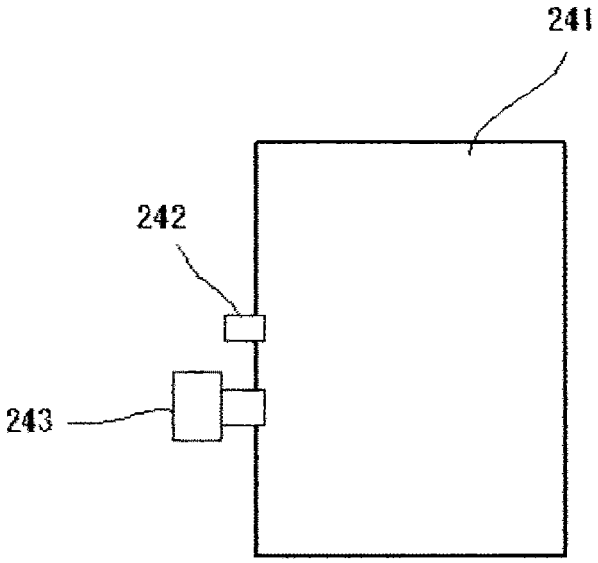
FIG. 5 is a diagram illustrating one example of an ink cartridge used in an image forming apparatus used for the image forming method of the present invention.
Figure 6:
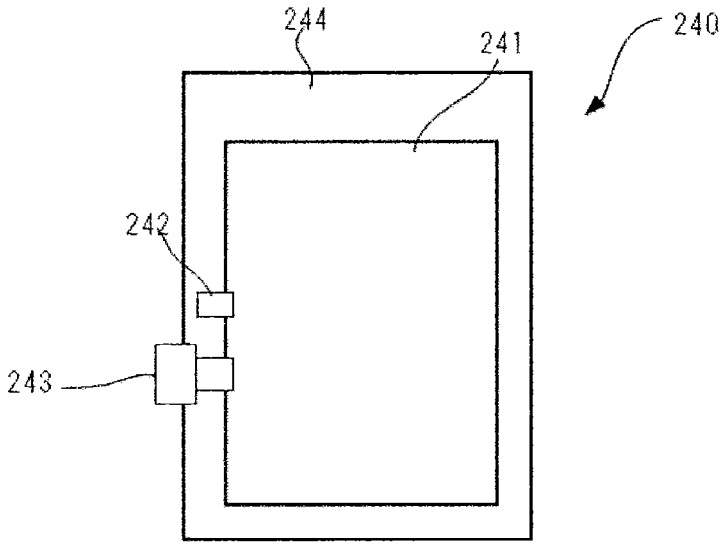
FIG. 6 is a diagram illustrating the ink cartridge of FIG. 5 including a casing (package).

Next, an ink cartridge is explained with reference to FIGS. 5 and 6. FIG. 5 is a diagram illustrating one example of the ink cartridge for use in the present invention, and FIG. 6 is a diagram including a casing (exterior) of the ink cartridge of FIG. 5.

As illustrated in FIG. 5, an ink bag 241 is filled with a recording ink from an ink inlet 242, and the ink inlet 242 is sealed by fusion bonding after releasing the air from the ink bag 241. At the time of use, a needle attached to the main body of the device is inserted into an ink outlet 243 formed of a rubber member to supply the ink to the device. The ink bag 241 is formed of a wrapping member, such as an air non-permeable aluminum laminate film. As illustrated in FIG. 6, the ink bag 241 is typically housed in a plastic cartridge case 244, which is then detachably mounted in use to various devices for ejecting a liquid as the ink cartridge 240.

By charging the ink cartridge 240 with the treatment liquid instead of the ink and using the cartridge as a cartridge for a treatment liquid, such cartridge can be used by detachably mounting in various image forming apparatuses, similar to the ink cartridge.

Figure 7:
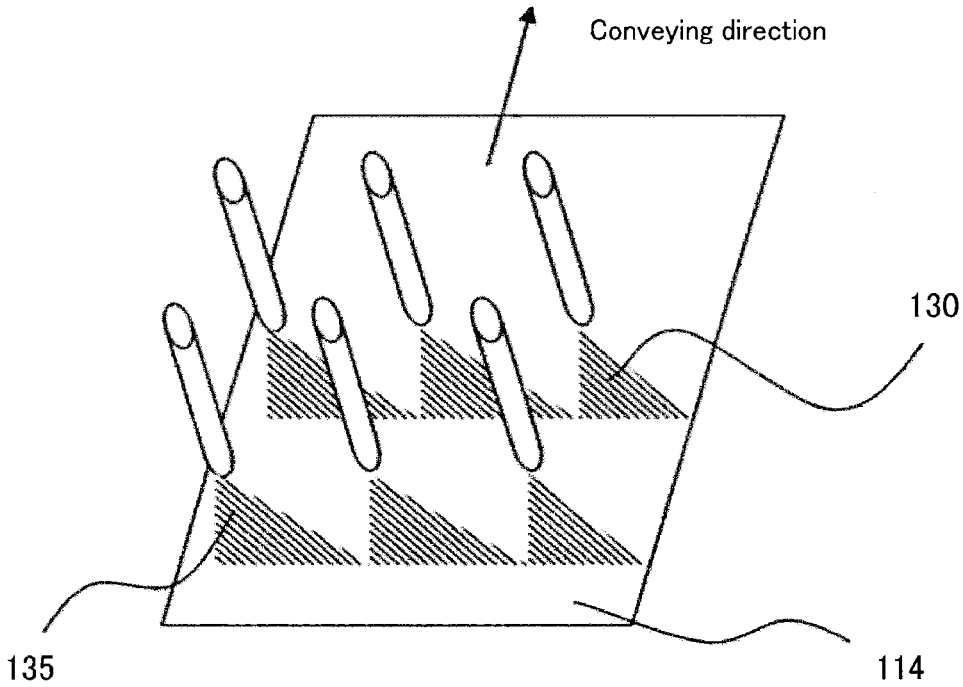
FIG. 7 is a schematic diagram illustrating one example of an ejection system from an ejection head in an image forming apparatus used for the image forming method of the present invention.
Figure 8:
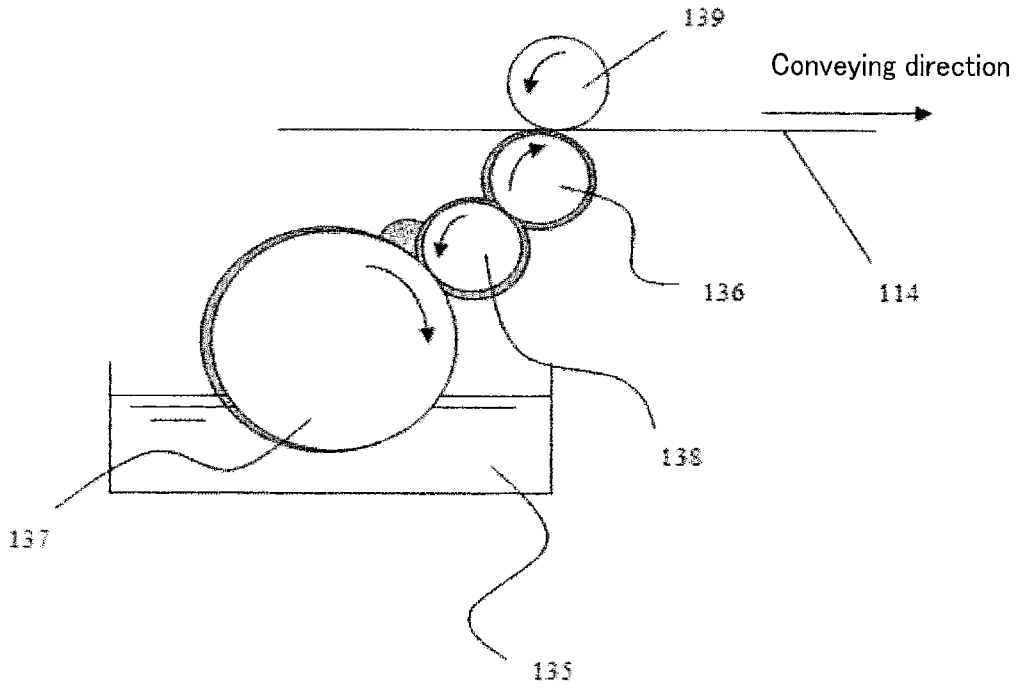
FIG. 8 is a schematic diagram illustrating one example of a coating system by three rollers.
Figure 9:
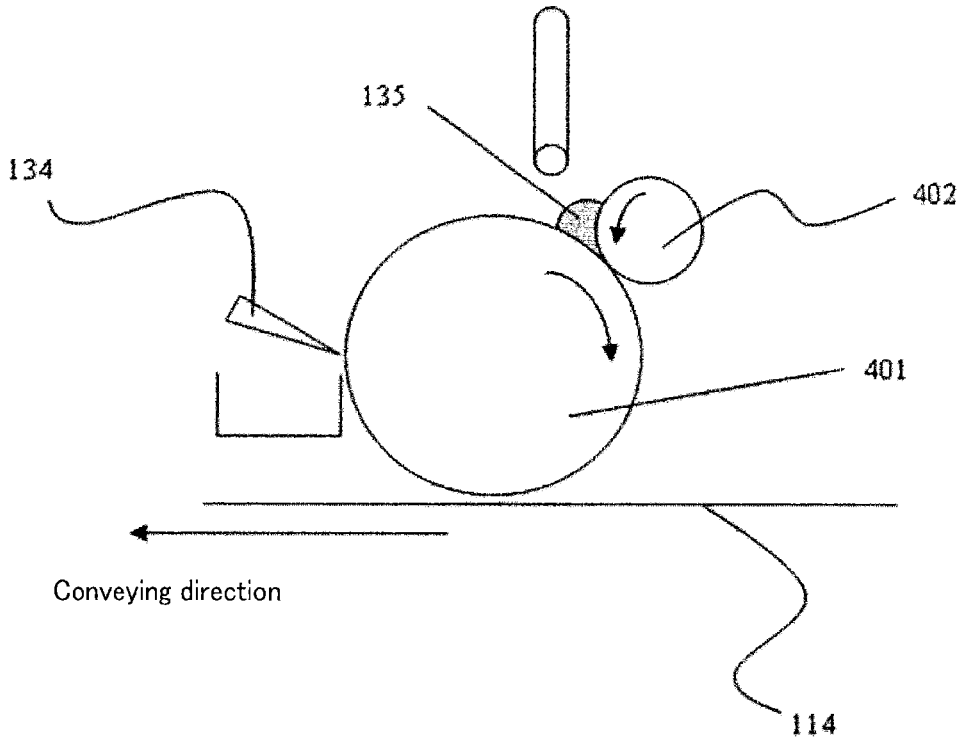
FIG. 9 is a schematic diagram illustrating one example of a coating system by two rollers.

Note that, examples of the embodiment for applying the treatment liquid onto a recording medium includes systems illustrated in FIGS. 7 to 9.

FIG. 7 depicts an ejection system from ejection heads. A recording head for ejecting the treatment liquid 135 is provided at the upper stream side of the conveying direction of the recording medium 114, and a recording head for the aqueous recording ink 130 is provided at downstream side of the conveying direction. As a result the treatment liquid 135 ejected in advance based on the predetermined image data can be mixed with the recording ink 130 on the recording medium 114.

FIG. 8 depicts a three-roller coating system, but the detailed explanations thereof are omitted, as they are disclosed in FIG. 1.

FIG. 9 depicts a two-roller coating system. The treatment liquid 135 ejected from an ejection head is applied on the recording medium 114 by controlling the thickness thereof to the predetermined thickness by the coating roller 401 and the film thickness controlling roller 402. Moreover, an excessive treatment liquid remained on the coating roller 401 is corrected by a mobile blade 134. Although it is not illustrated, an ejection heat for a recording ink is provided at the downstream side of the conveying direction in FIG. 9.

<Recording Medium>

The recording medium is appropriately selected depending on the intended purpose without any limitation. As for the recording medium, for example, plain paper, gloss paper, special paper, cloth, a film, an OHP sheet, and general-purpose printing paper can be suitably used.

Note that, in the case where the recording ink for use in the present invention is printed on a recording medium, water, which is a main component of the recording ink, penetrates inside the recording medium or evaporated into the air. As a result, the colorant solids are retained on a surface of the recording medium. In the case where a recording medium of non- or low ink absorbency is used, however, water does not sufficiently penetrate inside the recording medium, and as a result, water containing a colorant component is remained on a surface of the recording medium, which may impair abrasion resistance of a resulting image. However, the treatment liquid for use in the present invention can be suitably used for a recording medium of non- or low ink absorbency, and therefore use of the treatment liquid can provide a desirable image having excellent abrasion resistance.

EXAMPLES

The present invention will be more specifically explained through Examples hereinafter, but Examples shall not be construed to as limit the scope of the present invention.

<Preparation of Recording Ink>

(Synthesis of Carboxyl Group-Containing Resin)

A reaction vessel of an automatic polymerization reaction device (polymerization tester DSL-2AS, available from Todoroki Sangyo Co., Ltd.), which had the reaction vessel equipped with a stirrer, a dripping device, a thermosensor, and a nitrogen inlet device set the upper side of the vessel, was charged with 550 g of methyl ethyl ketone, and the internal atmosphere of the reaction vessel was replaced with nitrogen gas with stirring. After heating to 80° C. while maintaining the internal atmosphere of the reaction vessel to the nitrogen atmosphere, a mixed solution of 75.0 g of 2-hydroxyethyl methacrylate, 77.0 g of methacrylic acid, 80.0 g of styrene, 150.0 g of butyl methacrylate, 98.0 g of butyl acrylate, 20.0 g of methyl methacrylate, and 40.0 g of t-butylperoxy-2-ethylhexanate (PERBUTYL® O, manufactured by NOF CORPORATION) was added dropwise by the dripping device over 4 hours.

After the completion of dripping, the reaction mixture was further allowed to react at the same temperature for 15 hours, to thereby obtain a methyl ethyl ketone solution of an anionic group-containing styrene-acryl copolymer A having an acid value of 100 mgKOH/g, the weight average molecular weight of 21,000, and Tg (calculated value) of 31° C.

After the reaction, part of methyl ethyl ketone was removed under the reduced pressure to adjust a non-volatile component content thereof to 50%. In this manner, a copolymer A solution was obtained.

Preparation Example of Pigment Dispersion Liquid 1

A mixing chamber equipped with a cooling jacket was charged with 1,000 g of carbon black (RAVEN 1080, manufactured by Columbian Chemicals), 800 g of the copolymer A solution, 143 g of a 10% sodium hydroxide aqueous solution, 100 g of methyl ethyl ketone, and 1,957 g of water, and the mixture was stirred and mixed.

The resulting mixture was passed through a disperser (SC Mill SC 100, manufactured by Nippon Coke & Engineering Co., Ltd.) filled with zirconia beads having diameters of 0.3 mm to disperse the mixture in a circulation system (a system where the dispersion liquid from the disperser was returned to the mixing chamber) for 6 hours.

During this operation, the rotation number of the disperser was set at 2,700 rpm, and cold water was passed through the cooling jacket so that the temperature of the dispersion liquid was kept at 40° C. or lower.

After dispersing, the resulting dispersion liquid was taken out from the mixing chamber, followed by washing the mixing chamber and the flow paths of the disperser with 10,000 g of water. This washing water was then combined with the dispersion liquid to thereby obtain a diluted dispersion liquid. The diluted dispersion liquid was placed in a glass distillation apparatus to remove the entire volume of methyl ethyl ketone, and part of water. After cooling the dispersion liquid to room temperature, 10% hydrochloric acid was added dropwise to adjust the pH to 4.5 with stirring. Thereafter, the solids were collected through filtration performed by a Nutsche filtration device (Filter Dryer, manufactured by Japan Chemical Engineering & Machinery Co., Ltd.), and the resultant was washed with water.

The resulting cake was collected in a container, and 200 g of a 20% potassium hydroxide aqueous solution was added to the cake, followed by dispersing the mixture by a disperser (TK Homodisperser, manufactured by PRIMIX Corporation). To the resulting dispersion, water was added to adjust the non-volatile component, to thereby obtain Aqueous Pigment Dispersion Liquid 1 having the non-volatile component content of 20%, in which the carbon black was covered with a carboxyl group-containing styrene-acryl copolymer neutralized in potassium hydroxide to form a composite particle.

Preparation of Pigment Dispersion Liquid 2

Aqueous Pigment Dispersion Liquid 2 (cyan) was obtained in the same manner as Aqueous Pigment Dispersion Liquid 1, provided that the carbon black was replaced with copper phthalocyanine (SEIKALIGHT BLUE A612, manufactured by Dainichiseika Color & Chemicals Mfg. Co. Ltd.).

Preparation Example 1 of Ink

After homogeneously mixing the following materials with stirring for 1 hour, a defoaming agent was added to the mixture. The resulting mixture was homogeneously mixed by stirring for 1 hour. Thereafter, Aqueous Pigment Dispersion Liquid 1 was added, and the resulting mixture was homogeneously mixed by further stirring for 1 hour. The obtained mixture was filtered through a polyvinylidene fluoride membrane filter having the average pore diameter of 0.8 μm under pressure to remove coarse particles or dusts, to thereby obtain Recording Ink 1.

[Ink Composition]

| | |
|---|---|
| Aqueous Pigment Dispersion Liquid 1 | 8.0 parts by mass |
| Rosin-modified maleic acid resin (HARIMACK R-100, manufactured by Harima Chemicals Group, Inc.) | 2.0 parts by mass |
| Glycerin | 22.0 parts by mass |
| 1,3-Butanediol | 11.0 parts by mass |
| Fluorosurfactant represented by the structural formula (1) | 0.4 parts by mass |
| $C_4F_9$—$CH_2CH(OH)CH_2O$—$(CH_2CH_2O)_{23}$—$CH_2CH(OH)CH_2O$—$C_4F_9$ | Structural Formula (1) |
| 1,2-Octanediol | 2.0 parts by mass |
| 2-Amino-2-ethyl-1,3-propanediol | 0.5 parts by mass |
| Antibacterial agent (LV(S)) | 0.1 parts by mass |
| Defoaming agent (2,4,7,9-tetramethyldecane-4,7-diol) | 1.1 parts by mass |
| Ion-exchanged water | balance |
| | (Total: 100 parts by mass) |

Preparation Example 2 of Ink

Recording Ink 2 was obtained in the same manner as Recording Ink 1, provided that the amounts of the aqueous pigment dispersion liquid and rosin-modified maleic acid resin were changed as described below.

[Ink Composition]

| | |
|---|---|
| Aqueous Pigment Dispersion Liquid 2 | 8.0 parts by mass |
| Rosin-modified maleic acid resin (HARIMACK R-100, manufactured by Harima Chemicals Group, Inc.) | 3.0 parts by mass |
| Glycerin | 22.0 parts by mass |
| 1,3-Butanediol | 11.0 parts by mass |
| Fluorosurfactant represented by the structural formula (1) | 0.4 parts by mass |
| $C_4F_9$—$CH_2CH(OH)CH_2O$—$(CH_2CH_2O)_{23}$—$CH_2CH(OH)CH_2O$—$C_4F_9$ | Structural Formula (1) |
| 1,2-Octanediol | 2.0 parts by mass |
| 2-Amino-2-ethyl-1,3-propanediol | 0.5 parts by mass |
| Antibacterial agent (LV(S)) | 0.1 parts by mass |
| Defoaming agent (2,4,7,9-tetramethyldecane-4,7-diol) | 1.1 parts by mass |
| Ion-exchanged water | balance |
| | (Total: 100 parts by mass) |

<Preparation of Treatment Liquid>

—Synthesis of Alkali Salt of Olefin-Maleic Acid Copolymer—

A 1 L four-neck flask equipped with a stirrer, a condenser, dropping funnels, a thermometer, and a nitrogen inlet tube was charged with 76.8 g of maleic anhydride, and 120 g of xylene, and the resulting mixture was heated to reflux temperature (about 110° C.) under nitrogen flow with stirring. The dropping funnel was charged with 70.4 g of diisobutylene, and 70.4 g of 1-hexadecene, and another dropping funnel was charged with 6 g of t-butylperoxybenzoate, and 40 g of xylene.

The contents of both of the dropping funnels were added to the flask dropwise over 3 hours, and the resultant was subjected to reflux, and the temperature thereof was maintained for 4 hours. Thereafter, xylene was removed from the mixture under the reduced pressure to thereby obtain solids. After crushing the solids, 499 g of water was added to the solids, and the resultant was neutralized with 85.3 g of 25% aqueous ammonia to adjust the solid content thereof to 25% by mass, to thereby obtain Alkali Salt 1 of Copolymer having the viscosity of 330 mPa·s at 25° C. and pH of 8.5.

Preparation Example of Treatment Liquid

In accordance with each formulation presented in Tables 1 to 3, an organic solvent, a surfactant, a penetrating agent, an antibacterial agent, and water were homogeneously mixed with stirring. Then, a defoaming agent was added to the mixture, and the resulting mixture was homogeneously mixed by stirring for 1 hour.

Thereafter, polyacryl amide and Alkali Salt 1 were added to the resultant, and the mixture was homogeneously mixed by stirring for 1 hour.

Next, a cationic resin was added and the resulting mixture was homogeneously mixed by stirring for 1 hour, to thereby obtain each of Treatment Liquids 1 to 22.

TABLE 1

| | | Treatment Liquid No. | | | | | | |
|---|---|---|---|---|---|---|---|---|
| | | 1 | 2 | 3 | 4 | 5 | 6 | 7 |
| Organic solvent | Glycerin | 7.0 | 7.0 | 7.0 | 7.0 | 7.0 | 7.0 | 7.0 |
| | 1,3-butanediol | 5.0 | 5.0 | 5.0 | 5.0 | 5.0 | 5.0 | 5.0 |
| Polyacryl | Nonionic polyacryl amide | | 0.01 | | 1.00 | | | 0.01 |

TABLE 1-continued

| | | Treatment Liquid No. | | | | | | |
|---|---|---|---|---|---|---|---|---|
| | | 1 | 2 | 3 | 4 | 5 | 6 | 7 |
| amide | Cationic polyacryl amide | | | | | 1.00 | | |
| | Amphoteric polyacryl amide | | | | | | 1.00 | |
| Alkali salt of copolymer | Alkali Salt 1 of Copolymer | | | | 0.05 | 0.05 | 0.05 | |
| Cationic resin | Cationic Resin 1 (cationic degree = 5.66) | | | 1.0 | | 1.0 | 1.0 | 1.0 |
| | Cationic Resin 2 (cationic degree = 7.00) | | | | | | | |
| | Cationic Resin 3 (cationic degree = 2.80) | | | | 1.0 | | | |
| Surfactant | Fluorosurfactant 1 | 1.0 | 1.0 | 1.0 | | | | 1.0 |
| | Polyoxyalkylene alkylether | | | | 0.4 | 0.4 | 0.4 | |
| | Fluorosurfactant 2 | | | | | | | |
| Defoaming agent | Silicone-based defoaming agent | | | | | | | |
| | N-octyl-2-pyrrolidone | | | | 1.2 | 1.2 | 1.2 | |
| | 2,4,7,9-tetramethyldecane-4,7-diol | | | | | | | |
| | 2,5,8,11-tetramethyldodecane-5,8-diol | | | | | | | |
| Penetrating agent | 1,2-octanediol | 2.0 | 2.0 | 2.0 | 2.0 | 2.0 | 2.0 | 2.0 |
| Antibacterial agent | LV(S) | 0.1 | 0.1 | 0.1 | 0.1 | 0.1 | 0.1 | 0.1 |
| Antioxidant | Benzotriazole | 0.1 | 0.1 | 0.1 | 0.1 | 0.1 | 0.1 | 0.1 |
| Water | Ion-exchanged water | 84.8 | 84.8 | 83.8 | 82.2 | 82.2 | 82.2 | 83.8 |
| | Total | 100.0 | 100.0 | 100.0 | 100.0 | 100.0 | 100.0 | 100.0 |

TABLE 2

| | | Treatment Liquid No. | | | | | | | |
|---|---|---|---|---|---|---|---|---|---|
| | | 8 | 9 | 10 | 11 | 12 | 13 | 14 | 15 |
| Organic solvent | Glycerin | 7.0 | 7.0 | 7.0 | 7.0 | 7.0 | 7.0 | 7.0 | 7.0 |
| | 1,3-butanediol | 5.0 | 5.0 | 5.0 | 5.0 | 5.0 | 5.0 | 5.0 | 5.0 |
| Polyacryl amide | Nonionic polyacryl amide | 2.00 | 2.00 | 2.00 | 0.01 | 5.00 | 7.50 | 2.00 | 2.00 |
| | Cationic polyacryl amide | | | | | | | | |
| | Amphoteric polyacryl amide | | | | | | | | |
| Alkali salt of copolymer | Alkali Salt 1 of Copolymer | | | | | | | | |
| Cationic resin | Cationic Resin 1 (cationic degree = 5.66) | 0.10 | 0.10 | 0.10 | 0.001 | 0.25 | 0.38 | 0.10 | 0.10 |
| | Cationic Resin 2 (cationic degree = 7.00) | 35.0 | | 35.0 | 25.0 | 25.0 | 25.0 | 35.0 | 35.0 |
| | Cationic Resin 3 (cationic degree = 2.80) | | 35.0 | | | | | | |
| Surfactant | Fluorosurfactant 1 | | | | | | | | |
| | Polyoxyalkylene alkylether | 0.4 | 0.4 | 0.4 | 0.4 | 0.4 | 0.4 | 0.4 | 0.4 |
| | Fluorosurfactant 2 | | | | | | | | |
| Defoaming agent | Silicone-based defoaming agent | | | | | | | 1.2 | |
| | N-octyl-2-pyrrolidone | 1.2 | 1.2 | | 1.2 | 1.2 | 1.2 | | |
| | 2,4,7,9-tetramethyldecane-4,7-diol | | | | | | | | 1.2 |
| | 2,5,8,11-tetramethyldodecane-5,8-diol | | | | | | | | |
| Penetrating agent | 1,2-octanediol | 2.0 | 2.0 | 2.0 | 2.0 | 2.0 | 2.0 | 2.0 | 2.0 |
| Antibacterial agent | LV(S) | 0.1 | 0.1 | 0.1 | 0.1 | 0.1 | 0.1 | 0.1 | 0.1 |
| Antioxidant | Benzotriazole | 0.1 | 0.1 | 0.1 | 0.1 | 0.1 | 0.1 | 0.1 | 0.1 |
| Water | Ion-exchanged water | 47.1 | 47.1 | 48.3 | 59.2 | 54.0 | 51.3 | 47.1 | 47.1 |
| | Total | 100.0 | 100.0 | 100.0 | 100.0 | 100.0 | 100.0 | 100.0 | 100.0 |

TABLE 3

| | | Treatment Liquid No. | | | | | | |
|---|---|---|---|---|---|---|---|---|
| | | 16 | 17 | 18 | 19 | 20 | 21 | 22 |
| Organic solvent | Glycerin | 7.0 | 7.0 | 7.0 | 7.0 | 7.0 | 7.0 | 7.0 |
| | 1,3-butanediol | 5.0 | 5.0 | 5.0 | 5.0 | 5.0 | 5.0 | 5.0 |
| Polyacryl amide | Nonionic polyacryl amide | 2.00 | 2.00 | 2.00 | 200 | 2.00 | 2.00 | 2.00 |
| | Cationic polyacryl amide | | | | | | | |
| | Amphoteric polyacryl amide | | | | | | | |
| Alkali salt of copolymer | Alkali Salt 1 of Copolymer | 0.10 | 0.10 | 0.10 | 0.10 | 0.10 | 0.10 | 0.10 |
| Cationic resin | Cationic Resin 1 (cationic degree = 5.66) | 35.0 | 35.0 | 35.0 | 1.0 | 50.0 | 60.0 | 35.0 |
| | Cationic Resin 2 (cationic degree = 7.00) | | | | | | | |
| | Cationic Resin 3 (cationic degree = 2.80) | | | | | | | |
| Surfactant | Fluorosurfactant 1 | | | 1.0 | | | | |
| | Polyoxyalkylene alkylether | 0.4 | | | 0.4 | 0.4 | 0.4 | 0.4 |
| | Fluorosurfactant 2 | | 0.4 | | | | | |
| Defoaming agent | Silicone-based defoaming agent | | | | | | | |
| | N-octyl-2-pyrrolidone | | 1.2 | 1.2 | 1.2 | 1.2 | 1.2 | 1.2 |
| | 2,4,7,9-tetramethyldecane-4,7-diol | | | | | | | |
| | 2,5,8,11-tetramethyldodecane-5,8-diol | 1.2 | | | | | | |
| Penetrating agent | 1,2-octanediol | 2.0 | 2.0 | 2.0 | 2.0 | 2.0 | 2.0 | 2.0 |
| Antibacterial agent | LV(S) | 0.1 | 0.1 | 0.1 | 0.1 | 0.1 | 0.1 | 0.1 |
| Antioxidant | Benzotriazole | 0.1 | 0.1 | 0.1 | 0.1 | 0.1 | 0.1 | 0.1 |
| Water | Ion-exchanged water | 47.1 | 47.1 | 46.5 | 81.1 | 32.1 | 22.1 | 47.1 |
| | Total | 100.0 | 100.0 | 100.0 | 100.0 | 100.0 | 100.0 | 100.0 |

In the tables above, the details of the materials were as follows: Nonionic polyacryl amide (Haricoat 1057, manufactured by Harima Chemical Group, Inc.)

Cationic polyacryl amide (ARONFLOC E3500, manufactured by MT AquaPolymer, Inc.)

Amphoteric polyacryl amide (Polystron 372, manufactured by Arakawa Chemical Industries, Ltd.)

Polyoxyalkylene alkyl ether (EMULGEN 103, manufactured by Kao Corporation)

Fluorosurfactant 1 (Zonyl FS300, manufactured by Du Pont Kabushiki Kaisha, active ingredient: 40% by weight)

Fluorosurfactant 2 (fluorosurfactant represented by the structural formula (1))

Cationic Resin 1 (resin represented by the general formula (1), DK6810, manufactured by SEIKO PMC CORPORATION, cationic degree: 5.66)

Cationic Resin 2 (resin represented by the general formula (2),

Catiomaster PDT-2, manufactured by Yokkaichi Chemical Company, Limited, cationic degree: 7.00)

Cationic Resin 3 (polydiallyldimethyl ammonium chloride, UNISENCE CP-104, manufactured by SENKA Corporation, cationic degree: 2.80)

Silicone-based defoaming agent (KM-72F, manufactured by Shin-Etsu Chemical Co., Ltd.)

Comparative Example 1

Treatment Liquid 1 was uniformly applied onto a recording medium (OK Topcoat+, manufactured by Oji Paper Co., Ltd.) using a wire bar (coil diameter: 0.05 mm) manufactured by Kobayashi Manufacture Co., Ltd. to give a coating amount of 2 g/m$^2$.

Subsequently, Recording Ink 1 was ejected onto the recording medium by a device for ejecting a liquid (IPSIO GXe5500, manufactured by Ricoh Company Limited), to thereby obtain Print Sample 1. Note that, as for a printing chart, a solid image having an area of 3 cm$^2$, which was formed with a dot pattern, was used.

Comparative Example 2

Print Sample 2 was obtained in the same manner as Print Sample 1, provided that Treatment Liquid 1 was replaced with Treatment Liquid 2.

Comparative Example 3

Print Sample 3 was obtained in the same manner as Print Sample 1, provided that Treatment Liquid 1 was replaced with Treatment Liquid 3.

Comparative Example 4

Print Sample 4 was obtained in the same manner as Print Sample 1, provided that Treatment Liquid 1 was replaced with Treatment Liquid 4.

Comparative Example 5

Print Sample 5 was obtained in the same manner as Print Sample 1, provided that Treatment Liquid 1 was replaced with Treatment Liquid 5.

Comparative Example 6

Print Sample 6 was obtained in the same manner as Print Sample 1, provided that Treatment Liquid 1 was replaced with Treatment Liquid 6.

Comparative Example 7

Print Sample 7 was obtained in the same manner as Print Sample 1, provided that Treatment Liquid 1 was replaced with Treatment Liquid 7.

Example 1

Print Sample 8 was obtained in the same manner as Print Sample 1, provided that Treatment Liquid 1 was replaced with Treatment Liquid 8.

Example 2

Print Sample 9 was obtained in the same manner as Print Sample 1, provided that Treatment Liquid 1 was replaced with Treatment Liquid 9.

Example 3

Print Sample 10 was obtained in the same manner as Print Sample 1, provided that Treatment Liquid 1 was replaced with Treatment Liquid 10.

Example 4

Print Sample 11 was obtained in the same manner as Print Sample 1, provided that Treatment Liquid 1 was replaced with Treatment Liquid 11.

Example 5

Print Sample 12 was obtained in the same manner as Print Sample 1, provided that Treatment Liquid 1 was replaced with Treatment Liquid 12.

Example 6

Print Sample 13 was obtained in the same manner as Print Sample 1, provided that Treatment Liquid 1 was replaced with Treatment Liquid 13.

Example 7

Print Sample 14 was obtained in the same manner as Print Sample 1, provided that Treatment Liquid 1 was replaced with Treatment Liquid 14.

Example 8

Print Sample 15 was obtained in the same manner as Print Sample 1, provided that Treatment Liquid 1 was replaced with Treatment Liquid 15.

Example 9

Print Sample 16 was obtained in the same manner as Print Sample 1, provided that Treatment Liquid 1 was replaced with Treatment Liquid 16.

Example 10

Print Sample 17 was obtained in the same manner as Print Sample 1, provided that Treatment Liquid 1 was replaced with Treatment Liquid 17.

Example 11

Print Sample 18 was obtained in the same manner as Print Sample 1, provided that Treatment Liquid 1 was replaced with Treatment Liquid 18.

Example 12

Print Sample 19 was obtained in the same manner as Print Sample 1, provided that Treatment Liquid 1 was replaced with Treatment Liquid 19.

Example 13

Print Sample 20 was obtained in the same manner as Print Sample 1, provided that Treatment Liquid 1 was replaced with Treatment Liquid 20.

Example 14

Print Sample 21 was obtained in the same manner as Print Sample 1, provided that Treatment Liquid 1 was replaced with Treatment Liquid 21.

Example 15

Print Sample 22 was obtained in the same manner as Print Sample 1, provided that Treatment Liquid 1 was replaced with Treatment Liquid 22, and Recording Ink 1 was replaced to Recording Ink 2.

Various properties of Print Samples 1 to 22, and Treatment Liquids 1 to 22 were evaluated in the following manners. The results are presented in Table 4.

<Transfer Density (Abrasion Resistance)>

A solid imaging part of the solid image having an area of 3 $cm^2$, which was formed with a dot pattern, was rubbed with a cloth attached onto a clock meter (manufactured by TOYO SEIKI SEISAKU-SHO, LTD.) and the transfer density of the ink on the cloth after rubbing was measured using a spectrodensitometer (939) manufactured by X-Rite. The lower the transfer density is, the more preferable the fixing ability of the image is.

<Beading>

A solid imaging part of the solid image having an area of 3 $cm^2$, which was formed with a dot pattern, was visually observed, and a level of beading was ranked from 1 to 5. The larger the value is, the more preferable in terms of prevention of beading.

[Evaluation Criteria]

Rank 5: Beading was hardly observed.

Rank 4: Beading was very slightly observed, but it was not a problematic level.

Rank 3: Beading was slightly observed, but it was not problematic.

Rank 2: Beading was observed, and it was a level where the beading was clearly confirmed by visual observation.

Rank 1: Beading was significantly observed (the same level as when no treatment liquid was applied).

<Evaluation of Foaming: Foam Height after 30 Seconds>

Each of Treatment Liquids 1 to 22 (10 mL) was placed in a 100 mL measuring cylinder, and left to stand for 1 day. Thereafter, the measuring cylinder was placed in a thermostat water bath of 10° C. for 30 minutes or longer so that the liquid temperature was entirely constant. After the liquid temperature had sufficiently become constant, air was blown into the liquid with a predetermined syringe to generate foam up to 100 mL. After 30 seconds from foam generation, the height (mL) of the foam was visually confirmed. The foam height of 50 mL or less after 30 seconds is determined as excellent antifoaming property.

<Evaluation of Shelf Stability>

Each of Treatment Liquids 1 to 22 was placed in a 20 mL glass bottle, and was left to stand in a thermostat of 70° C. for 2 weeks. A difference (viscosity increase level) between the initial viscosity and the viscosity after stored for 2 weeks was measured, and the result was evaluated with the following 3 ranks. Note that, the viscosity was measured at 25° C. by means of a viscometer (SV-10, manufactured by A & D Company Limited).

[Evaluation Criteria]

A: The viscosity change rate from the initial viscosity was less than 1%.

B: The viscosity change rate from the initial viscosity was 1% or more but less than 5%.

C: The viscosity change rate from the initial viscosity was 5% or more.

TABLE 4

| | Treatment Liquid No. | Foam height after 30 seconds | Shelf stability | Transfer density | Beading |
|---|---|---|---|---|---|
| Comp. Ex. 1 | Treatment Liquid 1 | 90 | A | 0.41 | 1 |
| Comp. Ex. 2 | Treatment Liquid 2 | 90 | A | 0.20 | 1 |
| Comp. Ex. 3 | Treatment Liquid 3 | 90 | A | 0.35 | 2 |
| Comp. Ex. 4 | Treatment Liquid 4 | 0 | A | 0.14 | 2 |
| Comp. Ex. 5 | Treatment Liquid 5 | 0 | C | 0.14 | 2 |
| Comp. Ex. 6 | Treatment Liquid 6 | 0 | C | 0.13 | 2 |
| Comp. Ex. 7 | Treatment Liquid 7 | 90 | A | 0.18 | 2 |
| Ex. 1 | Treatment Liquid 8 | 0 | A | 0.05 | 5 |
| Ex. 2 | Treatment Liquid 9 | 0 | A | 0.03 | 5 |
| Ex. 3 | Treatment Liquid 10 | 30 | A | 0.05 | 5 |
| Ex. 4 | Treatment Liquid 11 | 0 | A | 0.16 | 4 |
| Ex. 5 | Treatment Liquid 12 | 0 | A | 0.09 | 4 |
| Ex. 6 | Treatment Liquid 13 | 0 | B | 0.08 | 4 |
| Ex. 7 | Treatment Liquid 14 | 50 | A | 0.05 | 5 |
| Ex. 8 | Treatment Liquid 15 | 0 | A | 0.05 | 5 |
| Ex. 9 | Treatment Liquid 16 | 0 | A | 0.05 | 5 |
| Ex. 10 | Treatment Liquid 17 | 0 | A | 0.04 | 5 |
| Ex. 11 | Treatment Liquid 18 | 40 | A | 0.06 | 5 |
| Ex. 12 | Treatment Liquid 19 | 0 | A | 0.08 | 3 |
| Ex. 13 | Treatment Liquid 20 | 0 | A | 0.14 | 5 |
| Ex. 14 | Treatment Liquid 21 | 0 | A | 0.17 | 5 |
| Ex. 15 | Treatment Liquid 22 | 0 | A | 0.04 | 5 |

The embodiments of the present invention are, for example, as follows:

<1> An image forming method containing:

applying a treatment liquid onto a recording medium; and applying a recording ink onto the recording medium, wherein the treatment liquid contains a cationic resin having a cationic degree of 5 or higher, nonionic polyacryl amide, an alkali salt of a C12-C18 olefin-maleic acid copolymer, an organic solvent, a surfactant, and water, and wherein the recording ink contains a colorant, an organic solvent, a surfactant, and water.

<2> The image forming method according to <1>, wherein the treatment liquid contains the cationic resin in an amount of 1% by mass to 50% by mass.

<3> The image forming method according to any of <1> or <2>, wherein the cationic resin has a structural unit represented by any of the following general formulae (1) and (2):

General Formula (1)

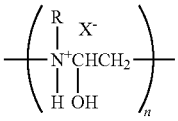

where $X^-$ is an anionic counter ion, R is an alkyl group, and n is an integer of 10 to 13, General Formula (2)

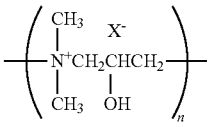

where $X^-$ in an anionic counter ion, and n is an integer of 10 to 13.

<4> The image forming method according to any one of <1> to <3>, wherein the treatment liquid contains the nonionic polyacryl amide in an amount of 0.01% by mass to 5% by mass.

<5> The image forming method according to any one of <1> to <4>, wherein the surfactant in the treatment liquid is at least one selected from the group consisting of polyoxyalkylene alkyl ether, and a fluorosurfactant represented by the following general formula (3):

$$C_nF_{2n+1}—CH_2CH(OH)CH_2O—(CH_2CH_2O)_a—Y \quad \text{General Formula (3)}$$

where n is an integer of 2 to 6; a is an integer of 15 to 50; and Y is $—C_bH_{2b+1}$ (provided that b is an integer of 11 to 19), or $CH_2CH(OH)CH_2—C_mF_{2m+1}$ (provided that m is an integer of 2 to 6).

<6> The image forming method according to any one of <1> to <5>, wherein the treatment liquid further contains a defoaming agent, and the defoaming agent is at least one selected from the group consisting of N-octyl-2-pyrrolidone, 2,4,7,9-tetramethyldecane-4,7-diol, and 2,5,8,11-tetramethyldodecane-5,8-diol.

<7> The image forming method according to any one of <1> to <6>, wherein the recording ink further contains a carboxyl group-containing resin.

<8> An image forming apparatus containing:

a treatment liquid applying unit configured to apply a treatment liquid onto a recording medium; and a recording ink applying unit configured to apply a recording ink onto the recording medium, wherein the treatment liquid contains a cationic resin having a cationic degree of 5 or higher, nonionic polyacryl amide, an alkali salt of a C12-C18 olefin-maleic acid copolymer, an organic solvent, a surfactant, and water, and wherein the recording ink contains a colorant, an organic solvent, a surfactant, and water.

<9> The image forming apparatus according to <8>, wherein the treatment liquid applying unit is either a liquid ejecting unit, or a coating unit.

<10> The image forming apparatus according to any of <8> or <9>, wherein the recording ink applying unit contains an inkjet unit.

This application claims priority to Japanese application No. 2012-242599, filed on Nov. 2, 2012 and incorporated herein by reference.

What is claimed is:

1. An image forming method comprising:

applying a treatment liquid onto a recording medium; and applying a recording ink onto the recording medium, wherein the treatment liquid comprises a cationic resin having a cationic degree of 5 or higher, nonionic polyacryl amide, an alkali salt of a C12-C18 olefin-maleic acid copolymer, an organic solvent, a surfactant, and water, the recording ink comprises a colorant, an organic solvent, a surfactant, and water, and the treatment liquid has a transfer density of from 0.03 to 0.09.

2. The image forming method according to claim 1, wherein the treatment liquid comprises the cationic resin in an amount of 1% by mass to 50% by mass.

3. The image forming method according to claim 1, wherein the cationic resin has a structural unit represented by any of the following formulae (1) and (2):

Formula (1)

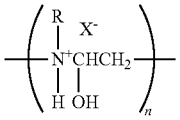

wherein $X^-$ is an anionic counter ion, R is an alkyl group, and n is an integer of 10 to 13, Formula (2)

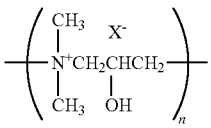

wherein $X^-$ in an anionic counter ion, and n is an integer of 10 to 13.

4. The image forming method according to claim 1, wherein the treatment liquid comprises the nonionic polyacryl amide in an amount of 0.01% by mass to 5% by mass.

5. The image forming method according to claim 1, wherein the surfactant in the treatment liquid is at least one selected from the group consisting of polyoxyalkylene alkyl ether, and a fluorosurfactant of formula (3):

$$C_nF_{2n+1}—CH_2CH(OH)CH_2O—(CH_2CH_2O)_a—Y \quad \text{Formula (3)}$$

wherein n is an integer of 2 to 6; a is an integer of 15 to 50; and Y is $—C_bH_{2b+1}$ provided that b is an integer of 11 to 19, or $CH_2CH(OH)CH_2—C_mF_{2m+1}$ provided that m is an integer of 2 to 6.

6. The image forming method according to claim 1, wherein the treatment liquid further comprises a defoaming agent, and the defoaming agent is at least one selected from the group consisting of N-octyl-2-pyrrolidone, 2,4,7,9-tetramethyldecane-4,7-diol, and 2,5,8,11-tetramethyldodecane-5,8-diol.

7. The image forming method according to claim 1, wherein the recording ink further comprises a carboxyl group-containing resin.

8. An image forming apparatus comprising:

a treatment liquid applying unit configured to apply a treatment liquid onto a recording medium, wherein the treatment liquid applying unit contains the treatment liquid; and a recording ink applying unit configured to apply a recording ink onto the recording medium, wherein the treatment liquid comprises a cationic resin having a cationic degree of 5 or higher, nonionic polyacryl amide, an alkali salt of a C12-C18 olefin-maleic acid copolymer, an organic solvent, a surfactant, and water, wherein the recording ink comprises a colorant, an organic solvent, a surfactant, and water, and the treatment liquid has a transfer density of from 0.03 to 0.09.

9. The image forming apparatus according to claim 8, wherein the treatment liquid applying unit is either a liquid ejecting unit, or a coating unit.

10. The image forming apparatus according to claim 8, wherein the recording ink applying unit comprises an inkjet unit.

* * * * *